US010334389B2

(12) United States Patent
Miyasaka et al.

(10) Patent No.: US 10,334,389 B2
(45) Date of Patent: Jun. 25, 2019

(54) AUDIO REPRODUCTION APPARATUS AND GAME APPARATUS

(71) Applicant: SOCIONEXT INC., Kanagawa (JP)

(72) Inventors: Shuji Miyasaka, Osaka (JP); Kazutaka Abe, Osaka (JP); Anh Tuan Tran, Singapore (SG); Zong Xian Liu, Singapore (SG); Yong Hwee Sim, Singapore (SG)

(73) Assignee: SOCIONEXT INC., Kanagawa (JP)

( * ) Notice: Subject to any disclaimer, the term of this patent is extended or adjusted under 35 U.S.C. 154(b) by 0 days.

(21) Appl. No.: 15/175,972

(22) Filed: Jun. 7, 2016

(65) Prior Publication Data

US 2016/0295342 A1 Oct. 6, 2016

Related U.S. Application Data

(63) Continuation of application No. PCT/JP2014/005780, filed on Nov. 18, 2014.

(30) Foreign Application Priority Data

Dec. 12, 2013 (JP) ..... 2013-257338
Dec. 12, 2013 (JP) ..... 2013-257342
Feb. 17, 2014 (JP) ..... 2014-027904

(51) Int. Cl.
*H04R 3/12* (2006.01)
*H04S 7/00* (2006.01)
(Continued)

(52) U.S. Cl.
CPC ..... *H04S 7/305* (2013.01); *G10K 11/346* (2013.01); *G10K 15/08* (2013.01); *H04R 3/12* (2013.01);
(Continued)

(58) Field of Classification Search
CPC . G10L 19/008; G10L 19/0204; G10L 19/167; G10L 19/20
(Continued)

(56) References Cited

U.S. PATENT DOCUMENTS 9,838,825 B2 * 12/2017 Helwani ..... H04S 7/303
2002/0131580 A1 * 9/2002 Smith ..... H04R 3/005 379/387.01
(Continued)

FOREIGN PATENT DOCUMENTS

JP 09-233599 A 9/1997
JP 2003-087893 A 3/2003
(Continued)

OTHER PUBLICATIONS

Spors, S. et al., "Physical and Perceptual Properties of Focused Sources in Wave Field Synthesis." Audio Engineering Society 127th Convention, New York, NY, USA, Oct. 9-12, 2009; pp. 1-19.
(Continued)

*Primary Examiner* — Alexander Jamal
(74) *Attorney, Agent, or Firm* — McDermott Will & Emery LLP

(57) ABSTRACT

An audio reproduction apparatus includes: a signal processing unit that converts an audio signal into N channel signals, where N is an integer greater than or equal to 3; and a speaker array including N speaker elements that respectively output the N channel signals as reproduced sound, wherein the signal processing unit includes: a beam formation unit that performs a beam formation process of resonating the reproduced sound output from the speaker array at a position of one ear of the listener; and a cancellation unit that performs a cancellation process of preventing the reproduced sound output from the speaker array from reaching a position of the other ear of the listener.

7 Claims, 24 Drawing Sheets

(51) Int. Cl.

| | |
|---|---|
| ***G10K 15/08*** | (2006.01) |
| ***H04R 5/04*** | (2006.01) |
| ***G10K 11/34*** | (2006.01) |
| ***H04R 29/00*** | (2006.01) |
| *H04R 5/02* | (2006.01) |

(52) U.S. Cl.
CPC ..... *H04R 5/04* (2013.01); *H04R 29/002* (2013.01); *H04S 7/307* (2013.01); *H04R 5/02* (2013.01); *H04R 2203/12* (2013.01); *H04S 7/30* (2013.01); *H04S 7/303* (2013.01); *H04S 2400/01* (2013.01); *H04S 2420/07* (2013.01)

(58) Field of Classification Search
USPC ..... 381/310, 17, 22, 71.8
See application file for complete search history.

(56) References Cited

U.S. PATENT DOCUMENTS

| | | | | |
|---|---|---|---|---|
| 2004/0151325 | A1 | 8/2004 | Hooley et al. | |
| 2004/0234083 | A1 | 11/2004 | Katou et al. | |
| 2006/0031276 | A1 | 2/2006 | Kumamoto et al. | |
| 2009/0010455 | A1 | 1/2009 | Suzuki et al. | |
| 2009/0161880 | A1 | 6/2009 | Hooley et al. | |
| 2010/0215184 | A1* | 8/2010 | Buck | H04M 9/082 381/66 |
| 2012/0093348 | A1* | 4/2012 | Li | H04S 3/002 381/300 |
| 2013/0121515 | A1 | 5/2013 | Hooley et al. | |
| 2013/0129103 | A1* | 5/2013 | Donaldson | G10K 11/16 381/71.1 |
| 2013/0272529 | A1* | 10/2013 | Lee | H04R 3/04 381/56 |
| 2013/0279723 | A1 | 10/2013 | Hooley et al. | |
| 2015/0245157 | A1* | 8/2015 | Seefeldt | H04R 5/02 381/303 |
| 2016/0080886 | A1* | 3/2016 | De Bruijn | H04S 7/302 381/17 |

FOREIGN PATENT DOCUMENTS

| | | | |
|---|---|---|---|
| JP | 2004-320516 | A | 11/2004 |
| JP | 2005-065231 | A | 3/2005 |
| JP | 2006-352732 | A | 12/2006 |
| JP | 2007-236005 | A | 9/2007 |
| JP | 2008-042272 | A | 2/2008 |
| JP | 2008-227804 | A | 9/2008 |
| JP | 2009-017137 | A | 1/2009 |
| JP | 2009-213931 | A | 9/2009 |
| JP | 2012-070135 | A | 4/2012 |
| JP | 2012-210450 | A | 11/2012 |
| JP | 2013-102389 | A | 5/2013 |
| JP | 2013-539286 | A | 10/2013 |

OTHER PUBLICATIONS

International Search Report issued in corresponding International Patent Application No. PCT/JP2014/005780, dated Jan. 6, 2015; with English translation.
Written Opinion issued in corresponding International Patent Application No. PCT/JP2014/005780, dated Jan. 6, 2015; with English translation.
Office Action issued in Japanese Patent Application No. 2015-552299 dated Nov. 6, 2018, with partial translation.

* cited by examiner

AUDIO REPRODUCTION APPARATUS AND GAME APPARATUS

CROSS REFERENCE TO RELATED APPLICATIONS

This is a continuation application of PCT International Application No. PCT/JP2014/005780 filed on Nov. 18, 2014, designating the United States of America, which is based on and claims priority of Japanese Patent Applications No. 2013-257342 filed on Dec. 12, 2013, No. 2013-257338 filed on Dec. 12, 2013, and No. 2014-027904 filed on Feb. 17, 2014. The entire disclosures of the above-identified applications, including the specifications, drawings and claims are incorporated herein by reference in their entirety.

FIELD

The present disclosure relates to an audio reproduction apparatus that localizes sound to a listener's ear, and a game apparatus that produces the enjoyment of a game by acoustic effects.

BACKGROUND

The technology of virtually providing a stereophonic sound field to a listener using two speakers has been developed in recent years. For example, the method of canceling crosstalk which occurs when outputting (reproducing) a binaurally recorded audio signal from two speakers is widely known (see Patent Literature (PTL) 1 as an example).

The technology of providing a virtual sound field to a listener using a speaker array is known, too (see PTL 2 as an example).

CITATION LIST

Patent Literature

[PTL 1] Japanese Unexamined Patent Application Publication No. 9-233599

[PTL 2] Japanese Unexamined Patent Application Publication No. 2012-70135

[PTL 3] Japanese Patent Publication No. 4840480

Non Patent Literature

[NPL 1] AES 127th Convention, New York N.Y., USA, 2009 Oct. 9-12 Physical and Perceptual Properties of Focused Sources in Wave Field Synthesis

SUMMARY

Technical Problem

With the technology of canceling crosstalk which occurs when outputting sound from two speakers, the relationship between the position of each speaker and the position of the listener is restricted by transfer characteristics. Accordingly, a desired effect cannot be achieved in the case where a constant relationship between the position of each speaker and the position of the listener is not maintained. In other words, the sweet spot is narrow.

The technology of virtually generating a sound field using a speaker array can widen the sweet spot. However, since the plane waves output from the speaker array need to be crossed at the position of the listener, the speaker array needs to be in a crossed arrangement. The speaker arrangement is thus restricted.

The present disclosure provides an audio reproduction apparatus that can localize predetermined sound to a listener's ear without using binaural recording, with an eased restriction on the arrangement of speakers (speaker elements).

Solution to Problem

An audio reproduction apparatus according to an aspect of the present disclosure is an audio reproduction apparatus that localizes sound to an ear of a listener, and includes: a signal processing unit that converts an audio signal into N channel signals, where N is an integer greater than or equal to 3; and a speaker array including at least N speaker elements that respectively output the N channel signals as reproduced sound, wherein the signal processing unit includes: a beam formation unit that performs a beam formation process of resonating the reproduced sound output from the speaker array at a position of one ear of the listener; and a cancellation unit that performs a cancellation process of preventing the reproduced sound output from the speaker array from reaching a position of the other ear of the listener, and the N channel signals are obtained by performing the beam formation process and the cancellation process on the audio signal.

With this structure, the sound (sound image) can be localized to the listener's ear using a linear speaker array.

Moreover, N may be an even number, and the cancellation unit may perform a crosstalk cancellation process which is the cancellation process on each of N/2 pairs of N signals generated by performing the beam formation process on the audio signal, to generate the N channel signals.

With this structure, a filter (its constant) used in the crosstalk cancellation process is determined only from the geometric positional relationship between the listener and the combination of speaker elements. The filter used in the crosstalk cancellation process can thus be defined simply.

Moreover, the cancellation unit may perform a crosstalk cancellation process which is the cancellation process on the audio signal, based on a transfer function of an input signal to the beam formation unit being output from the speaker array as reproduced sound and reaching the ear of the listener, and the beam formation unit may perform the beam formation process on the audio signal on which the crosstalk cancellation process has been performed, to generate the N channel signals.

With this structure, the crosstalk cancellation process is performed on the audio signal before being divided into N channel signals, which requires less computation.

Moreover, the beam formation unit may include: a band division filter that generates band signals by dividing the audio signal into predetermined frequency bands; a distribution unit that distributes the generated band signals to each of channels corresponding to the N speaker elements; a position/band-specific filter that performs a filter process on each of the distributed band signals depending on a position of a speaker element to which the band signal is distributed and a frequency band of the band signal, and output a resulting band signal as a filtered signal; and a band synthesis filter that band-synthesizes a plurality of filtered signals belonging to a same channel.

With this structure, the beam formation process is controlled for each frequency band, which contributes to higher sound quality.

Moreover, the band division filter may divide the audio signal into a high-frequency band signal and a low-frequency band signal, and the position/band-specific filter may, in the case where the filter process is performed on H high-frequency band signals out of N distributed high-frequency band signals where H is a positive integer less than or equal to N, perform the filter process on L low-frequency band signals out of N distributed low-frequency band signals where L is a positive integer less than H.

With this structure, the sound in the low-frequency band and the sound in the high-frequency band can be balanced.

Moreover, the position/band-specific filter may perform the filter process on the distributed band signal, to cause an amplitude of a filtered signal of a specific channel to be greater than each of amplitudes of filtered signals of channels adjacent to the specific channel on both sides.

With this structure, the sound pressure between the channels of the speaker elements can be equalized.

Moreover, the signal processing unit may further include a low-pitch enhancement unit that adds a harmonic component of a low-frequency part of the audio signal before the cancellation process, to the audio signal.

With this structure, low-pitch sound lost due to the crosstalk cancellation process can be compensated for by utilizing the missing fundamental phenomenon.

An audio reproduction apparatus according to an aspect of the present disclosure is an audio reproduction apparatus that localizes sound to an ear of a listener, and includes: a signal processing unit that converts an audio signal into a left channel signal and a right channel signal; a left speaker element that outputs the left channel signal as reproduced sound; and a right speaker element that outputs the right channel signal as reproduced sound, wherein the signal processing unit includes: a low-pitch enhancement unit that adds a harmonic component of a low-frequency part of the audio signal, to the audio signal; and a cancellation unit that performs a cancellation process on the audio signal to which the harmonic component has been added, to generate the left channel signal and the right channel signal, the cancellation process being a process of preventing the reproduced sound output from the right speaker element from reaching a position of a left ear of the listener and preventing the reproduced sound output from the left speaker element from reaching a position of a right ear of the listener.

With this structure, in the case where the number of speaker elements is 2, low-pitch sound lost due to the crosstalk cancellation process can be compensated for by utilizing the missing fundamental phenomenon.

An audio reproduction apparatus according to an aspect of the present disclosure is an audio reproduction apparatus including: a signal processing unit that converts an audio signal into a left channel signal and a right channel signal; a left speaker element that outputs the left channel signal as reproduced sound; and a right speaker element that outputs the right channel signal as reproduced sound, wherein the signal processing unit includes a filter designed to localize sound of the audio signal to a predetermined position and cause the sound to be enhanced and perceived at a position of one ear of a listener facing the left speaker element and the right speaker element, and converts the audio signal processed by the filter into the left channel signal and the right channel signal, and the predetermined position is in the same area as the one ear of the listener from among two areas separated by a straight line connecting a position of the listener and one of the left speaker element and the right speaker element that corresponds to the one ear, when viewed from above.

With this structure, the sound (sound image) can be localized to the listener's ear using two speaker elements.

Moreover, the signal processing unit may further include a crosstalk cancellation unit that performs, on the audio signal, a cancellation process of preventing the sound of the audio signal from being perceived in the other ear of the listener, to generate the left channel signal and the right channel signal, and a straight line connecting the predetermined position and the position of the listener may be approximately in parallel with a straight line connecting the left speaker element and the right speaker element, when viewed from above.

With this structure, the sound can be localized to the listener's ear using two speaker elements and a simple filter structure.

An audio reproduction apparatus according to an aspect of the present disclosure is an audio reproduction apparatus that localizes sound to an ear of a listener, and includes: a signal processing unit that converts an audio signal into a left channel signal and a right channel signal; a left speaker element that outputs the left channel signal as reproduced sound; and a right speaker element that outputs the right channel signal as reproduced sound, wherein the signal processing unit performs a filter process using: a first transfer function of sound from a virtual sound source placed on a side of the listener to a first ear of the listener nearer the virtual sound source; a second transfer function of sound from the virtual sound source to a second ear of the listener opposite to the first ear; a first parameter by which the first transfer function is multiplied; and a second parameter by which the second transfer function is multiplied.

With this structure, the moving virtual sound source can be recreated with a high sense of realism, using two speaker elements and a simple filter structure.

Moreover, in the case where the first parameter is $\alpha$, the second parameter is $\beta$, and a ratio $\alpha/\beta$ of the first parameter and the second parameter is R, the signal processing unit may: set R to a first value close to 1, when a distance between the virtual sound source and the listener is a first distance; and set R to a second value greater than the first value, when the distance between the virtual sound source and the listener is a second distance that is shorter than the first distance.

With this structure, the sense of perspective between the position of the virtual sound source and the position of the listener can be recreated using two speaker elements and a simple filter structure.

Moreover, in the case where the first parameter is $\alpha$, the second parameter is $\beta$, and a ratio $\alpha/\beta$ of the first parameter and the second parameter is R, the signal processing unit may: set R to a value greater than 1, when a position of the virtual sound source is approximately 90 degrees with respect to a front direction of the listener; and set R to be closer to 1, when the position of the virtual sound source deviates more from approximately 90 degrees with respect to the front direction of the listener.

With this structure, the acoustic effect of the movement of the virtual sound source on the listener's side can be produced using two speaker elements and a simple filter structure.

A game apparatus according to an aspect of the present disclosure is a game apparatus including: an expectation value setting unit that sets an expectation value of a player winning a game; an acoustic processing unit that outputs an acoustic signal corresponding to the expectation value set by the expectation value setting unit; and at least two sound output units that output the acoustic signal output from the acoustic processing unit, wherein the acoustic processing unit, in the case where the expectation value set by the expectation value setting unit is greater than a predetermined threshold, outputs the acoustic signal processed by a filter with stronger crosstalk cancellation performance than in the case where the expectation value is less than the threshold.

With this structure, in the case where the expectation value is high, the acoustic signal processed by the filter with stronger crosstalk cancellation performance than in the case where the expectation value is low is output, so that the player can feel a higher sense of expectation of winning the game from the sound heard in his or her ear. For example, the sense of expectation of the player winning the game can be produced by a whisper or sound effect heard in the player's ear. The sense of expectation of the player winning the game can be heightened in this way.

Moreover, the acoustic processing unit may determine, in a filter process using: a first transfer function of sound from a virtual sound source placed on a side of the player to a first ear of the player nearer the virtual sound source; a second transfer function of sound from the virtual sound source to a second ear of the player opposite to the first ear; a first parameter by which the first transfer function is multiplied; and a second parameter by which the second transfer function is multiplied, the first parameter and the second parameter depending on the expectation value set by the expectation value setting unit, to output the acoustic signal processed by the filter with stronger crosstalk cancellation performance.

With this structure, the parameters are determined depending on the expectation value. Accordingly, for example, the degree of the sense of expectation of the player winning the game can be produced by the loudness of a whisper or sound effect heard in the player's ear.

Moreover, the acoustic processing unit may, in the case where the expectation value set by the expectation value setting unit is greater than the threshold, determine the first parameter and the second parameter that differ from each other more than in the case where the expectation value is less than the threshold.

With this structure, when the expectation value is higher, the sound heard in one ear increases and the sound heard in the other ear decreases. Accordingly, for example, the degree of the sense of expectation of the player winning the game can be produced by a whisper or sound effect heard in the player's ear.

Moreover, the acoustic processing unit may include: a storage unit that stores a first acoustic signal processed by the filter with stronger crosstalk cancellation performance, and a second acoustic signal processed by a filter with weaker crosstalk cancellation performance than the first acoustic signal; and a selection unit that selects and outputs the first acoustic signal in the case where the expectation value set by the expectation value setting unit is greater than the threshold, and selects and outputs the second acoustic signal in the case where the expectation value set by the expectation value setting unit is less than the threshold.

With this structure, the sense of expectation of the player winning the game can be heightened by a simple process.

A game apparatus according to an aspect of the present disclosure is a game apparatus including: an expectation value setting unit that sets an expectation value of a player winning a game; an acoustic processing unit that outputs an acoustic signal corresponding to the expectation value set by the expectation value setting unit; and at least two sound output units that output the acoustic signal output from the acoustic processing unit, wherein the acoustic processing unit, in the case where the expectation value set by the expectation value setting unit is greater than a predetermined threshold, adds a larger reverberation component to the acoustic signal than in the case where the expectation value is less than the threshold, and outputs a resulting acoustic signal.

With this structure, in the case where the expectation value is high, a larger reverberation component is added to the acoustic signal than in the case where the expectation value is low. Thus, the sense of expectation of the player winning the game can be produced by the surroundness of sound in the space around the player.

Moreover, the expectation value setting unit may include: a probability setting unit that sets a probability of winning the game; a timer unit that measures duration of the game; and an expectation value control unit that sets the expectation value, based on the probability set by the probability setting unit and the duration measured by the timer unit.

With this structure, the intension of the game apparatus to let the player win the game and the sense of expectation of the player winning the game can be synchronized.

Advantageous Effects

The audio reproduction apparatus according to the present disclosure can localize predetermined sound to a listener's ear without using binaural recording, with an eased restriction on the speaker array arrangement.

BRIEF DESCRIPTION OF DRAWINGS

These and other objects, advantages and features of the invention will become apparent from the following description thereof taken in conjunction with the accompanying drawings that illustrate a specific embodiment of the present disclosure.

DESCRIPTION OF EMBODIMENTS (Underlying Knowledge Forming Basis of the Present Disclosure)

The technology of virtually providing a stereophonic sound field to a listener using two speakers has been developed, as described in the Background section. For example, the method of canceling crosstalk when outputting a binaurally recorded audio signal from two speakers is widely known.

Binaural recording means recording sound waves reaching both ears of a human, by picking up sounds by microphones fitted in both ears of a dummy head. A listener can perceive spatial acoustics at the time of recording, by listening to the reproduced sound of such a recorded audio signal using headphones.

In the case of listening to the sound using speakers, however, the effect of binaural recording is lost because the sound picked up in the right ear also reaches the left ear and the sound picked up in the left ear also reaches the right ear. A conventionally known method to solve this is a crosstalk cancellation process.

Figure 1:
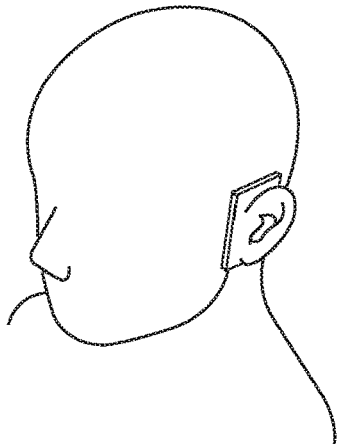
FIG. 1 is a diagram illustrating an example of a dummy head.
Figure 2:
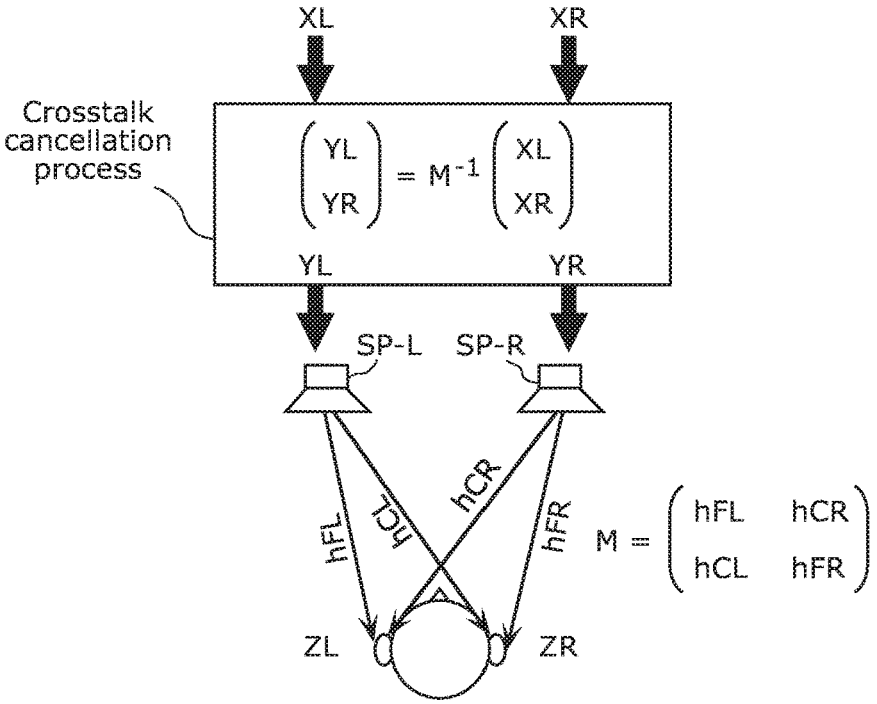
FIG. 2 is a diagram illustrating a typical crosstalk cancellation process.

FIG. 2 is a diagram illustrating a typical crosstalk cancellation process. In FIG. 2, hFL denotes the transfer function of sound from a left ch speaker SP-L to a listener's left ear, hCL denotes the transfer function of sound from the left ch speaker SP-L to the listener's right ear, hFR denotes the transfer function of sound from a right ch speaker SP-R to the listener's right ear, and hCR denotes the transfer function of sound from the right ch speaker SP-R to the listener's left ear. In this case, the matrix M of the transfer functions is the matrix illustrated in FIG. 2.

In FIG. 2, XL denotes a signal recorded in a dummy head's left ear, XR denotes a signal recorded in the dummy head's right ear, ZL denotes a signal reaching the listener's left ear, and ZR denotes a signal reaching the listener's right ear.

When the reproduced sound of the signal [YL, YR] obtained by multiplying the input signal [XL, XR] by the inverse matrix $M^{-1}$ of the matrix M is output from the left ch speaker SP-L and the right ch speaker SP-R, the signal obtained by multiplying the signal [YL, YR] by the matrix M reaches the listener's ears.

Thus, the input signal [XL, XR] is the signal [ZL, ZR] reaching the listener's left and right ears. In other words, the crosstalk components (the sound reaching the listener's right ear out of the sound wave output from the left ch speaker SP-L, and the sound reaching the listener's left ear out of the sound wave output from the right ch speaker SP-R) are canceled. This method is widely known as a crosstalk cancellation process.

Figure 3:
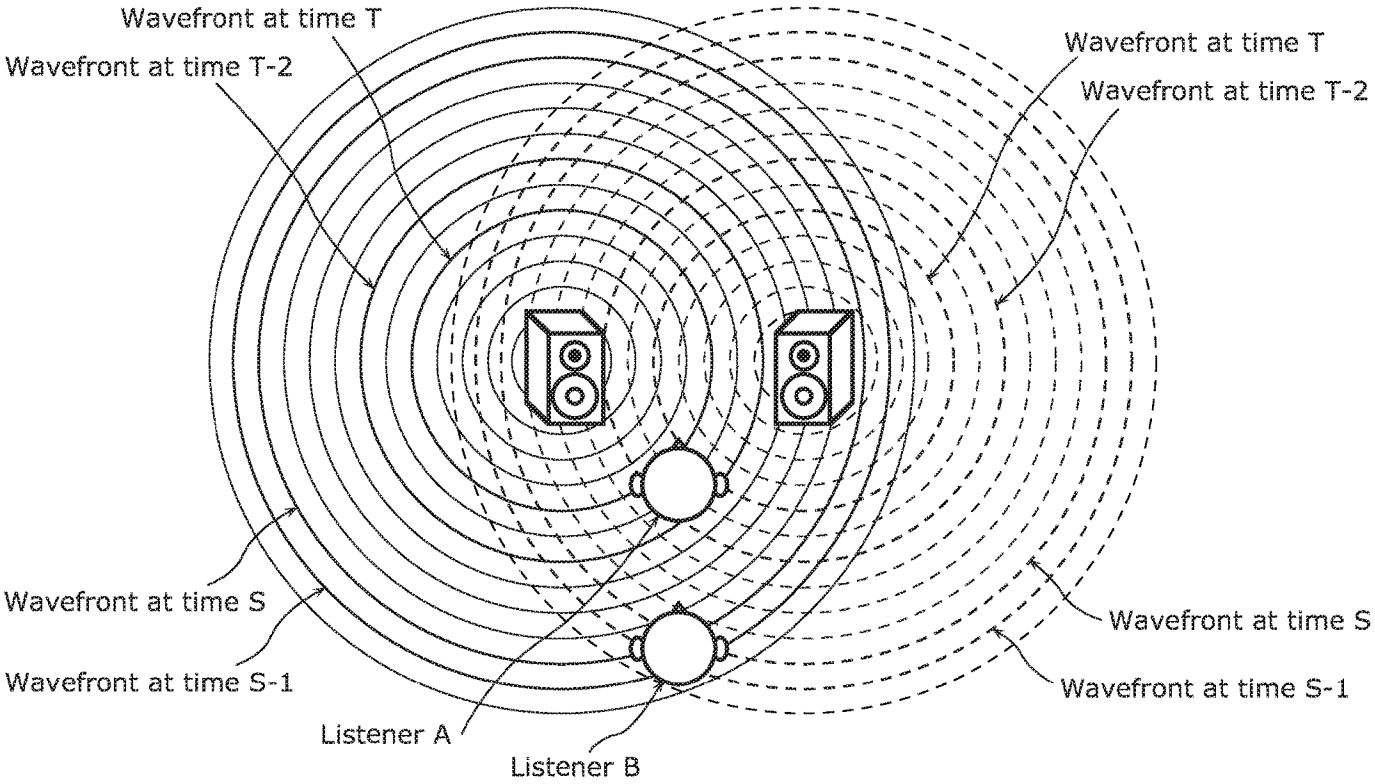
FIG. 3 is a diagram illustrating the wavefronts of sounds output from two speakers and the positions of listeners.

With the technology of canceling crosstalk of sound output from two speakers, the relationship between the position of each speaker and the position of the listener is restricted by transfer characteristics. Accordingly, a desired effect cannot be achieved in the case where a constant relationship between the position of each speaker and the position of the listener is not maintained. FIG. 3 is a diagram illustrating the wavefronts of sounds output from two speakers and the positions of listeners.

As illustrated in FIG. 3, sound having concentric wavefronts is output from each speaker. The dashed circles indicate the wavefronts of the sound output from the right speaker in FIG. 3. The solid circles indicate the wavefronts of the sound output from the left speaker in FIG. 3.

In FIG. 3, when the wavefront at time T of the right speaker reaches the right ear of listener A, the wavefront at time T-2 of the left speaker reaches the right ear of listener A. When the wavefront at time T of the left speaker reaches the left ear of listener A, the wavefront at time T-2 of the right speaker reaches the left ear of listener A.

Moreover, in FIG. 3, when the wavefront at time S of the right speaker reaches the right ear of listener B, the wavefront at time S-1 of the left speaker reaches the right ear of listener B. When the wavefront at time S of the left speaker reaches the left ear of listener B, the wavefront at time S-1 of the right speaker reaches the left ear of listener B.

Thus, the difference between the time of arrival of the wavefront of the sound from the left speaker and the time of arrival of the wavefront of the sound from the right speaker differs between the position of listener A and the position of listener B in FIG. 3. Accordingly, if such transfer characteristics that allow a stereophonic sound field to be perceived most effectively at the position of listener A are set in FIG. 3, the sense of realism is lower at the position of listener B than at the position of listener A.

In other words, the sweet spot is narrow with the technology of canceling crosstalk of sound output from two speakers.

The technology of alleviating such narrowness of the sweet spot using plane waves generated by a speaker array is known (see PTL 2 as an example).

This technology of virtually generating a sound field using a speaker array can widen the sweet spot.

Figure 4:
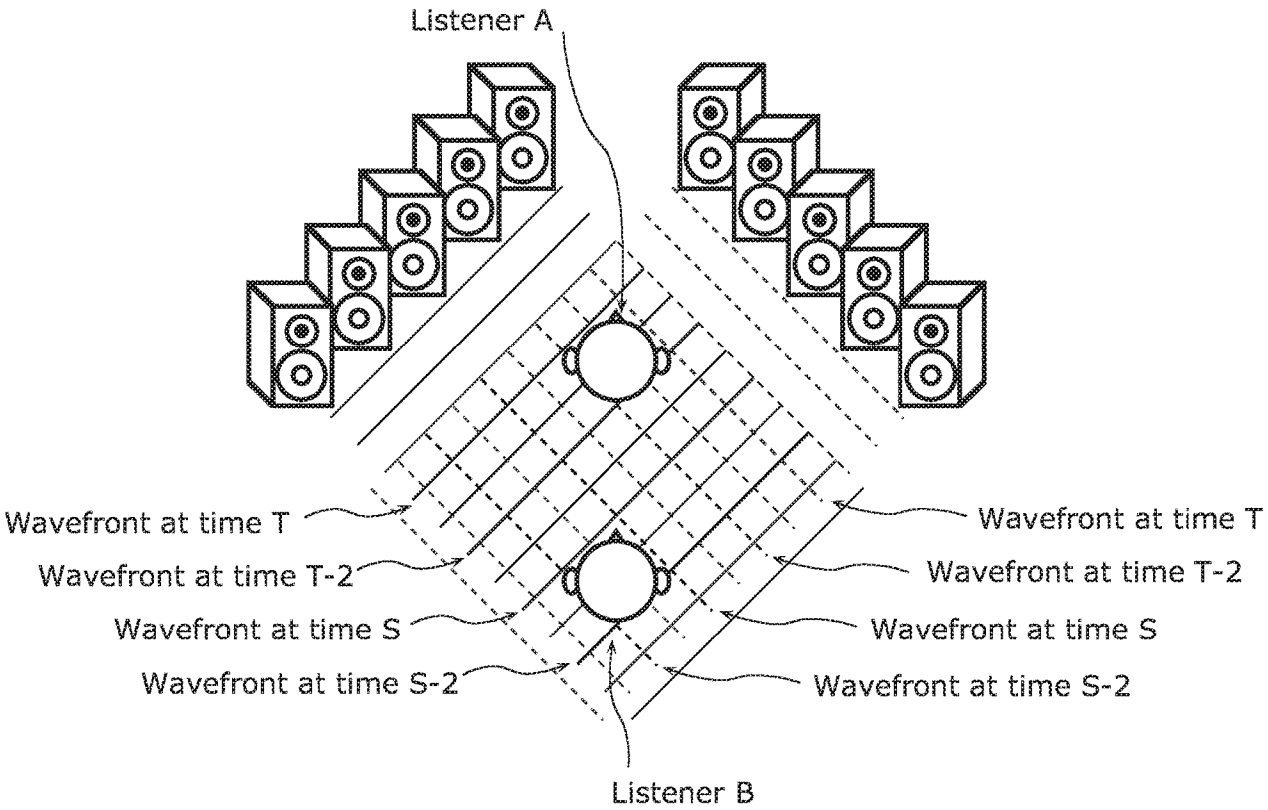
FIG. 4 is a diagram illustrating the relationship between the wavefronts of plane waves output from a speaker array and the positions of listeners.

FIG. 4 is a diagram illustrating the relationship between the wavefronts of plane waves output from a speaker array and the positions of listeners. As illustrated in FIG. 4, each speaker array outputs a plane wave that travels perpendicularly to its wavefronts. In FIG. 4, the dashed lines indicate the wavefronts of the plane wave output from the right speaker array, and the solid lines indicate the wavefronts of the plane wave output from the left speaker array.

In FIG. 4, when the wavefront at time T of the right speaker reaches the right ear of listener A, the wavefront at time T-2 of the left speaker reaches the right ear of listener A. When the wavefront at time T of the left speaker reaches the left ear of listener A, the wavefront at time T-2 of the right speaker reaches the left ear of listener A.

Moreover, in FIG. 4, when the wavefront at time S of the right speaker reaches the right ear of listener B, the wavefront at time S-2 of the left speaker reaches the right ear of listener B. When the wavefront at time S of the left speaker reaches the left ear of listener B, the wavefront at time S-2 of the right speaker reaches the left ear of listener B.

Thus, the difference between the time of arrival of the wavefront of the sound from the left speaker and the time of arrival of the wavefront of the sound from the right speaker is the same at the position of listener A and at the position of listener B in FIG. 4. Accordingly, if such transfer characteristics that allow a stereophonic sound field to be perceived most effectively at the position of listener A are set in FIG. 4, the stereophonic sound field can be perceived effectively at the position of listener B, too. The sweet spot is therefore wider in FIG. 4 than in FIG. 3.

With the technology of virtually generating a sound field using a speaker array, however, the plane waves output from the speaker array need to be crossed at the position of the listener. The structure illustrated in FIG. 4 cannot be realized solely by a linear speaker array, and a wide space is needed to arrange the speaker array. In other words, the technology of virtually generating a sound field using a speaker array has a restriction (space restriction) on the speaker array arrangement.

In view of this, the present disclosure provides an audio reproduction apparatus having an eased restriction on the arrangement of speakers (speaker elements) without using binaural recording.

For example, the present disclosure provides an audio reproduction apparatus that can localize predetermined sound from only a linear speaker array, to a listener's ear.

It is known that low-frequency band signals tend to attenuate in the above-mentioned crosstalk cancellation process. This is described in detail in PTL 1. Although PTL 1 discloses a solution to this, a plurality of crosstalk cancellation signal generation filters need to be connected in multiple stages according to the disclosed solution, which requires enormous computation.

In view of this, the present disclosure provides an audio reproduction apparatus that can recover low-frequency signals lost as a result of a crosstalk cancellation process, with low computational complexity.

The following describes embodiments in detail with reference to drawings as appropriate. In the following, description detailed more than necessary may be omitted. For example, detailed description of well-known matters or repeated description of the substantially same structures may be omitted. This is to avoid unnecessarily redundant description and facilitate the understanding of a person skilled in the art.

The accompanying drawings and the following description are provided to help a person skilled in the art to fully understand the present disclosure, and are not intended to limit the subject matter defined in the appended claims.

Embodiment 1

Figure 5:
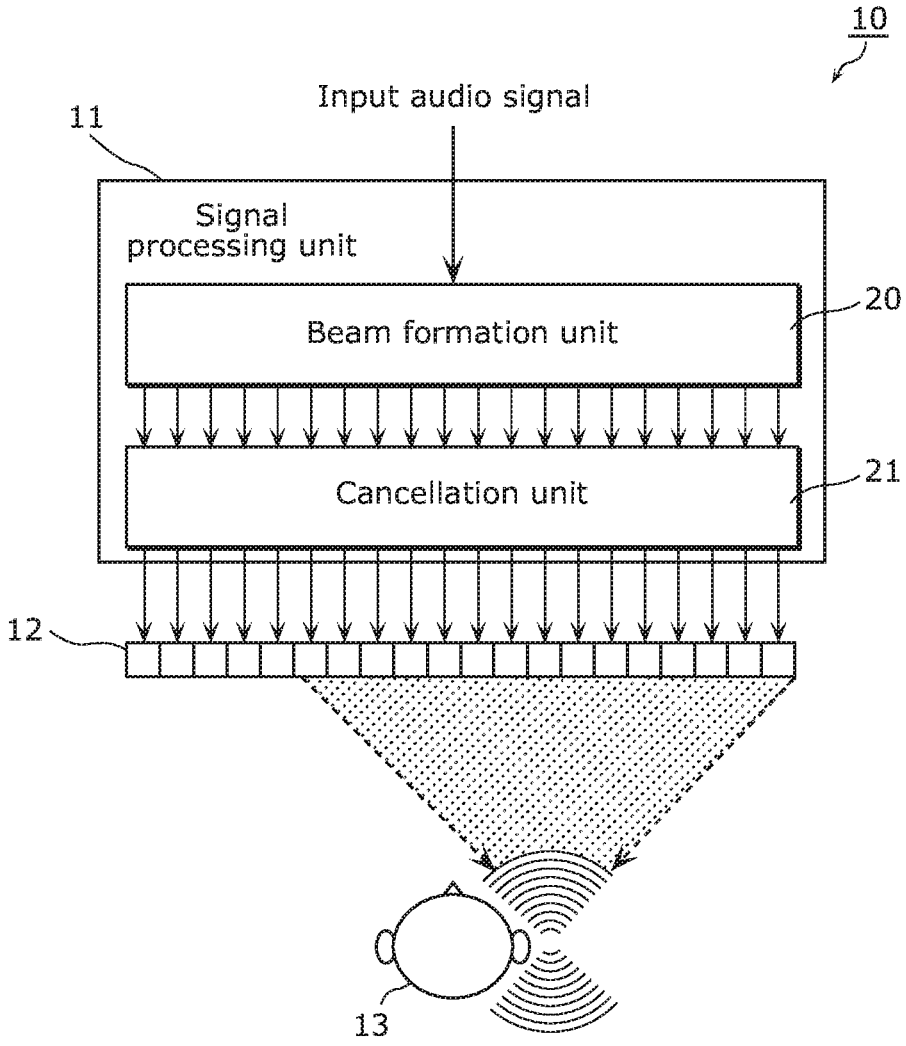
FIG. 5 is a diagram illustrating the structure of an audio reproduction apparatus according to Embodiment 1.

An audio reproduction apparatus according to Embodiment 1 is described below, with reference to drawings. FIG. 5 is a diagram illustrating the structure of the audio reproduction apparatus according to Embodiment 1.

As illustrated in FIG. 5, an audio reproduction apparatus 10 includes a signal processing unit 11 and a speaker array 12. The signal processing unit 11 includes a beam formation unit 20 and a cancellation unit 21.

The signal processing unit 11 converts an input audio signal into N channel signals. While N=20 in Embodiment 1, N may be an integer greater than or equal to 3. The N channel signals are obtained by performing the below-mentioned beam formation process and cancellation process on the input audio signal.

The speaker array 12 includes at least N speaker elements for reproducing the N channel signals (outputting the N channel signals as reproduced sound). In Embodiment 1, the speaker array 12 includes 20 speaker elements.

The beam formation unit 20 performs a beam formation process of resonating the reproduced sound output from the speaker array 12 at the position of one ear of a listener 13.

The cancellation unit 21 performs a cancellation process of preventing the reproduced sound of the input audio signal output from the speaker array 12 from reaching the position of the other ear of the listener 13.

The beam formation unit 20 and the cancellation unit 21 constitute the signal processing unit 11.

The following description assumes that the listener 13 faces the speaker array 12, unless stated otherwise.

The operation of the audio reproduction apparatus 10 having the above-mentioned structure is described below.

First, the beam formation unit 20 performs the beam formation process on the input audio signal so that the reproduced sound output from the speaker array 12 resonates at the position of one ear of the listener. The beam formation method may be any conventionally known method. For example, the method described in Non Patent Literature (NPL) 1 may be used.

Figure 6:
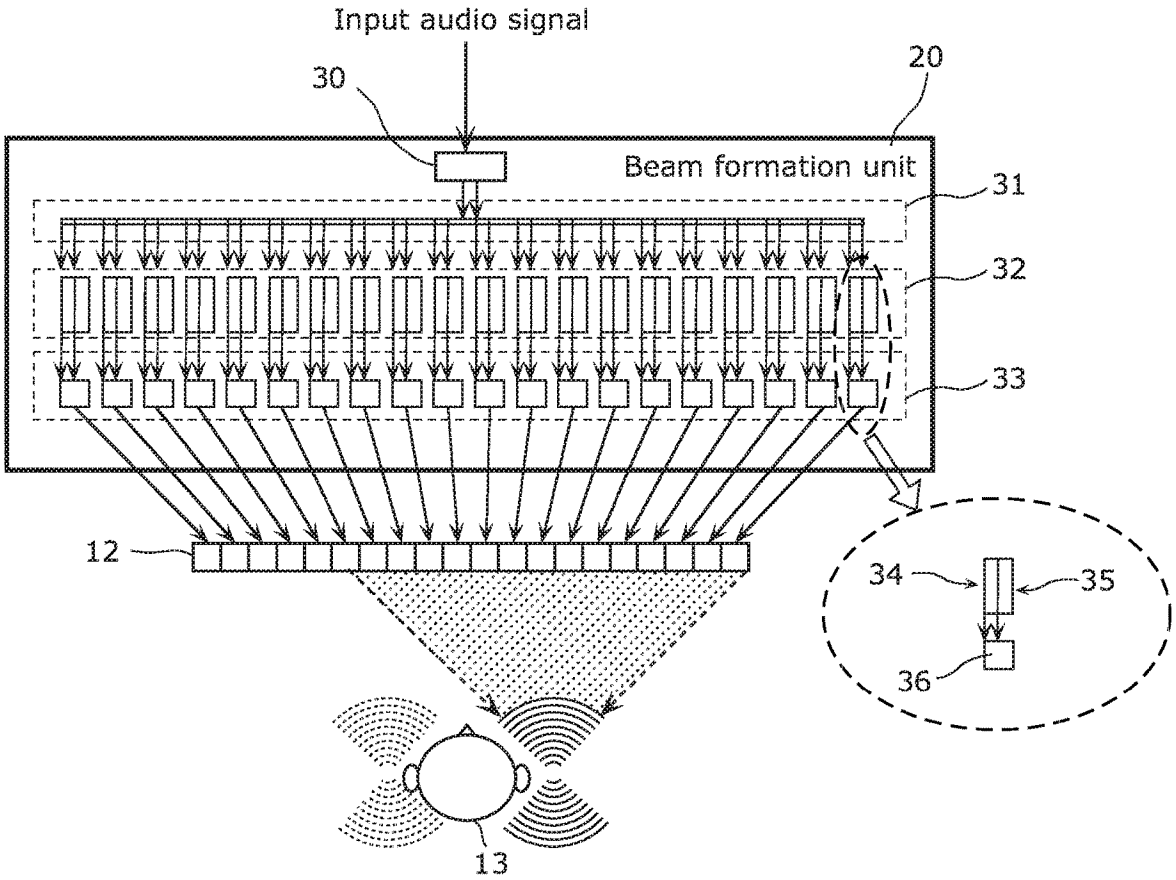
FIG. 6 is a diagram illustrating the structure of a beam formation unit.
Figure 7:
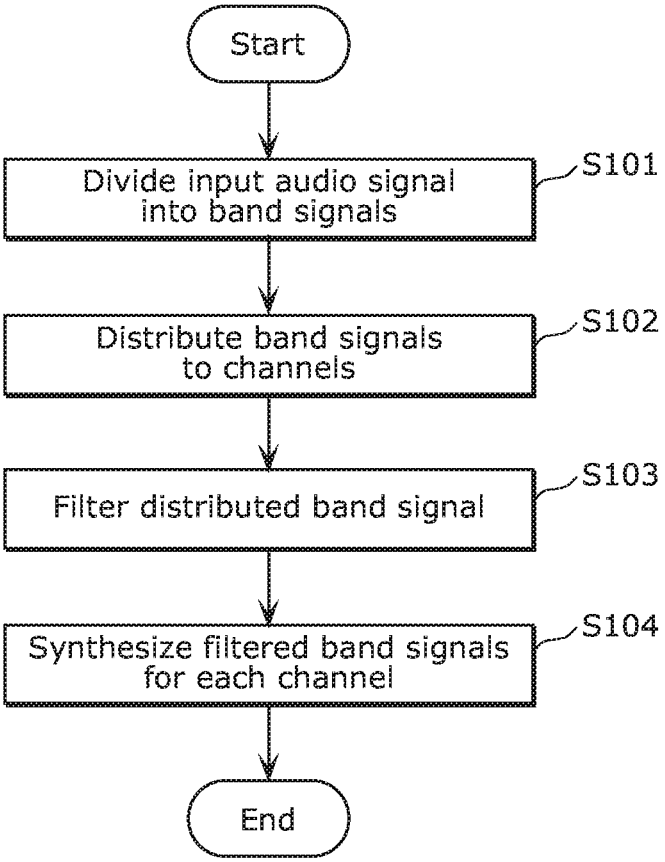
FIG. 7 is a flowchart of the operation of the beam formation unit.

A new beam formation process discovered by the inventors is described in Embodiment 1, with reference to FIGS. 6 and 7. FIG. 6 is a diagram illustrating the structure of the beam formation unit 20 according to Embodiment 1. To chiefly describe the beam formation unit 20, the cancellation unit 21 in FIG. 5 is omitted in FIG. 6.

The beam formation unit 20 in FIG. 6 corresponds to the beam formation unit 20 in FIG. 5. The beam formation unit 20 includes a band division filter 30, a distribution unit 31, a position/band-specific filter group 32, and a band synthesis filter group 33.

The band division filter 30 divides the input audio signal into band signals of a plurality of frequency bands. In other words, the band division filter 30 generates a plurality of band signals by dividing the input audio signal into predetermined frequency bands.

The distribution unit 31 distributes the band signals to the channels corresponding to the speaker elements in the speaker array 12.

The position/band-specific filter group 32 filters each of the distributed band signals depending on the channel (speaker element position) to which the band signal is distributed and the frequency band of the band signal. The position/band-specific filter group 32 outputs the filtered signals.

The band synthesis filter group 33 band-synthesizes the filtered signals output from the position/band-specific filter group 32, at each position.

The operation of the beam formation unit 20 having the above-mentioned structure is described in detail below, with reference to FIGS. 6 and 7. FIG. 7 is a flowchart of the beam formation process according to Embodiment 1.

First, the band division filter 30 divides the input audio signal into band signals of a plurality of frequency bands (Step S101). Although the input audio signal is divided into two band signals of a high-frequency signal and a low-frequency signal in Embodiment 1, the input audio signal may be divided into three or more band signals. The low-frequency signal is a part of the input audio signal in a band less than or equal to a predetermined frequency, and the high-frequency signal is a part of the input audio signal in a band greater than the predetermined frequency.

Next, the distribution unit 31 distributes each of the band signals (the high-frequency signal and the low-frequency signal) to the 20 channels corresponding to the 20 speaker elements in the speaker array 12 (Step S102).

The position/band-specific filter group 32 filters each of the distributed band signals according to the channel (speaker element position) to which the band signal is distributed and the frequency band of the band signal (Step S103). The filter process is described in detail below.

The position/band-specific filter group 32 in Embodiment 1 includes a low-frequency signal processing unit 34 and a high-frequency signal processing unit 35, as illustrated in FIG. 6. The low-frequency signal processing unit 34 processes the low-frequency signal, and the high-frequency signal processing unit 35 processes the high-frequency signal.

Each of the low-frequency signal processing unit 34 and the high-frequency signal processing unit 35 executes at least a delay process and an amplitude increase/decrease process. Each of the low-frequency signal processing unit 34 and the high-frequency signal processing unit 35 processes the distributed band signal so that a sound wave of a strong (high) sound pressure level is formed in the right ear of the listener 13 in FIG. 6.

In detail, each of the low-frequency signal processing unit 34 and the high-frequency signal processing unit 35 performs a delay process of assigning a largest delay and an amplification process with a largest gain, on the band signal distributed to the channel (speaker element) nearest the right ear of the listener 13.

Each of the low-frequency signal processing unit 34 and the high-frequency signal processing unit 35 assigns a smaller delay and performs amplification with a smaller gain (attenuation), on the band signal distributed to the channel that is farther from the right ear of the listener 13 in the right or left direction.

Thus, each of the low-frequency signal processing unit 34 and the high-frequency signal processing unit 35 performs a delay process of assigning a larger delay and an amplification process of assigning a larger gain, on the band signal distributed to the channel nearer the right ear of the listener 13. In other words, each of the low-frequency signal processing unit 34 and the high-frequency signal processing unit 35 filters the distributed band signal so that the amplitude of the filtered signal of a specific channel is greater than each of the amplitudes of the filtered signals of the channels adjacent to the specific channel on both sides. In this way, the beam formation unit 20 exercises such control that resonates the sound (sound wave) output from each speaker element at the position of the right ear of the listener 13.

Here, the low-frequency signal does not need to be reproduced in all speaker elements. The low-frequency signal has greater resonance between sound waves output from adjacent speaker elements, than the high-frequency signal. Accordingly, the low-frequency signal may not necessarily be output from all speaker elements that output the high-frequency signal, to keep a perceptual balance between the high-frequency component and the low-frequency component.

For example, in the case where the high-frequency signal processing unit 35 filters H high-frequency signals out of the distributed N high-frequency signals (H is a positive integer less than or equal to N), the low-frequency signal processing unit 34 may filter L low-frequency signals out of the distributed N low-frequency signals (L is a positive integer less than H). In this case, the position/band-specific filter group 32 does not output the unfiltered band signal(s).

After Step S103, the band synthesis filter group 33 band-synthesizes the filtered signals output from the position/band-specific filter group 32, for each channel (Step S104). In other words, the band synthesis filter group 33 band-synthesizes the filtered signals (the filtered signal of the low-frequency signal and the filtered signal of the high-frequency signal) belonging to the same channel. In detail, the band synthesis filter group 33 has a plurality of (20) band synthesis filters 36 corresponding to the channels, and each band synthesis filter 36 synthesizes the filtered signals of the corresponding channel (speaker element position) to generate a time-axis signal.

By the beam formation process described above, sound with a strong sound pressure level is localized to the right ear of the listener 13 in FIG. 6. Here, some amount of sound wave also reaches the left ear of the listener 13, though its sound pressure level is lower than that of the right ear. This impairs the listener 13's perceptual psychology that "the input audio signal is being reproduced in the right ear".

Figure 8:
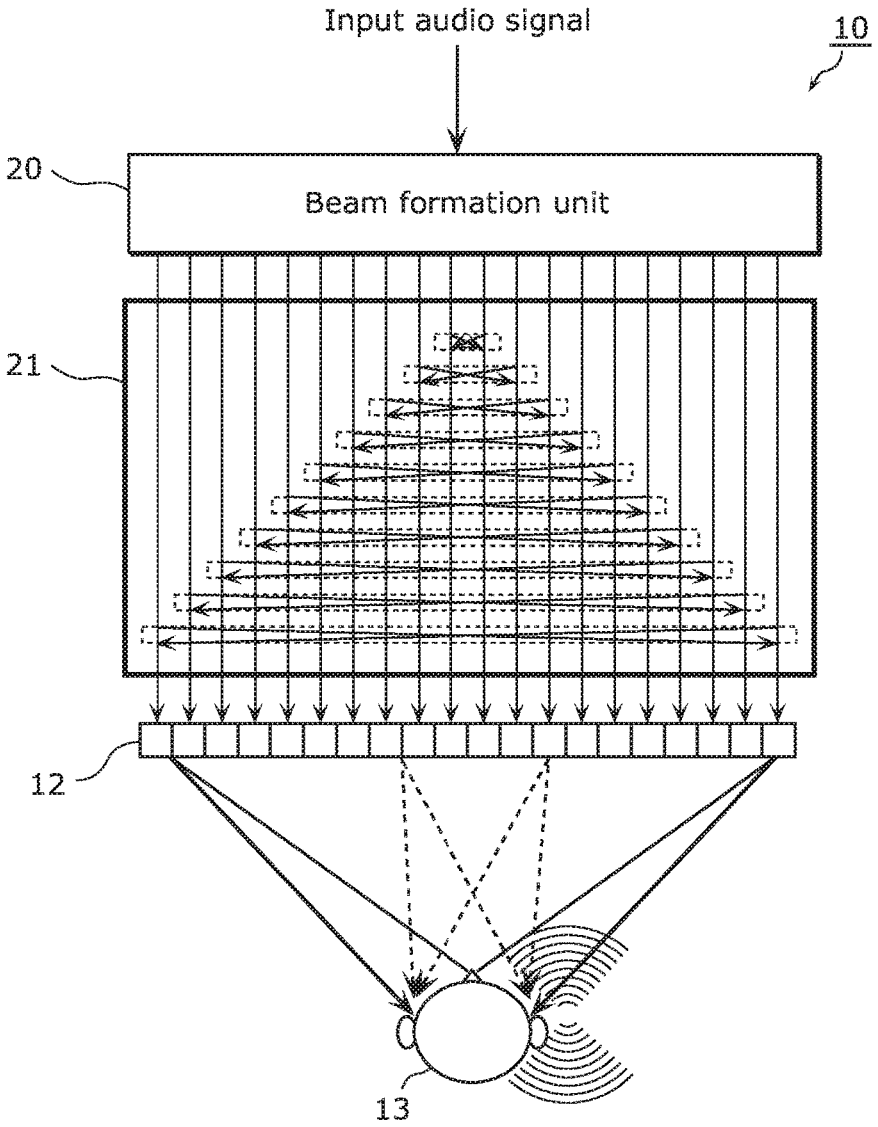
FIG. 8 is a diagram illustrating the structure of a cancellation unit.
Figure 9:
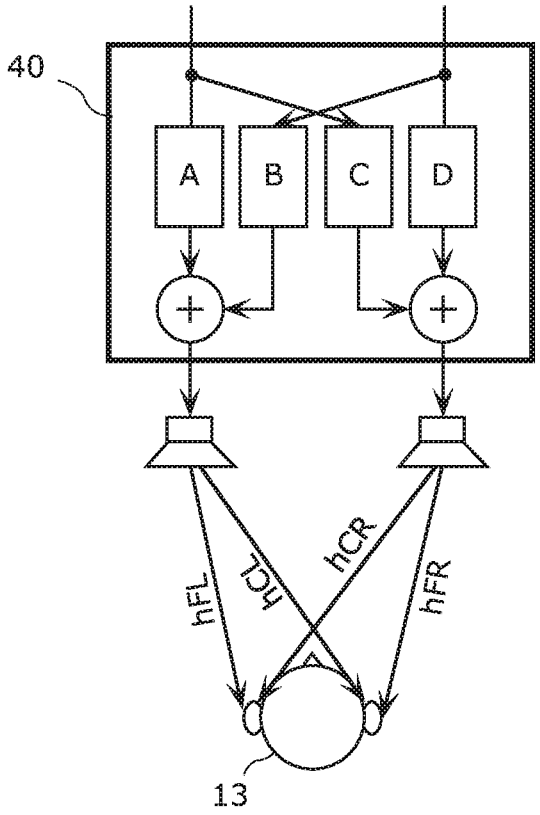
FIG. 9 is a diagram illustrating the structure of a crosstalk cancellation unit.

In view of this, the cancellation unit 21 in the audio reproduction apparatus 10 reduces the sound wave reaching the left ear of the listener 13. The operation of the cancellation unit 21 is described below, with reference to FIGS. 8 and 9. FIG. 8 is a diagram illustrating the structure of the cancellation unit 21 according to Embodiment 1. FIG. 9 is a diagram illustrating the structure of a crosstalk cancellation unit according to Embodiment 1. To chiefly describe the cancellation unit 21, the detailed structure of the beam formation unit 20 in FIG. 5 is omitted in FIG. 8.

In FIG. 8, the beam formation unit 20 corresponds to the beam formation unit 20 in FIG. 5, and the cancellation unit 21 corresponds to the cancellation unit 21 in FIG. 5. The speaker array 12 in FIG. 8 corresponds to the speaker array 12 in FIG. 5, and includes 20 speaker elements (N=20).

The cancellation unit 21 in FIG. 8 includes N/2 (=10) crosstalk cancellation units 40 (FIG. 9). In FIG. 8, 10 dotted frames (horizontally long boxes) in the cancellation unit 21 each represent a crosstalk cancellation unit 40. The crosstalk cancellation unit 40 has the structure illustrated in FIG. 9.

The crosstalk cancellation unit 40 cancels crosstalk of a pair of channels. The pair of channels are channels positioned symmetrically with respect to the center of the linearly arranged speaker elements in the direction of the linear arrangement. Suppose the linearly arranged speaker elements in FIG. 8 have the channel numbers 1, 2, . . . N (=20) from left to right. Then, the pair of channels are channels whose channel number sum is N+1.

When the transfer functions from the speaker elements of the pair of channels (positions) to the listener's ears are hFL, hCL, hCR, and hFR as illustrated in FIG. 9, the matrix M having these transfer functions as elements and the elements (A, B, C, D) of the inverse matrix $M^{-1}$ of the matrix M have the following relationship.

[Math. 1]

$$M^{-1} = \begin{pmatrix} A & C \\ B & D \end{pmatrix} \text{ when } M = \begin{pmatrix} hFL & hCR \\ hCL & hFR \end{pmatrix}.$$

The crosstalk cancellation unit 40 multiplies the signals (the two signals corresponding to the pair of channels) input to the crosstalk cancellation unit 40 (the cancellation unit 21) by the transfer functions A, B, C, and D, as illustrated in FIG. 9.

The crosstalk cancellation unit 40 then adds the multiplied signals together, as illustrated in FIG. 9. The added signals (channel signals) are output (reproduced) from the corresponding speaker elements. The crosstalk component between the ears resulting from the sound output from the speakers of the pair of channels is canceled in this way. This has been described in the section "Underlying Knowledge Forming Basis of the Present Disclosure". The crosstalk cancellation method may be any other method.

Such a crosstalk cancellation process is performed on N/2 pairs, as illustrated in FIG. 8. The N channel signals generated as a result are output (reproduced) from the respective speaker elements of the speaker array 12.

By the crosstalk cancellation process described above, the sound wave of the strong sound pressure level (amplitude) localized to the right ear of the listener 13 by the beam formation process is prevented from reaching the left ear of the listener 13. This raises the listener 13's perceptual psychology that "the input audio signal is being reproduced in the right ear".

Although the number N of speaker elements is N=20 in Embodiment 1, this is an example, and the number N of speaker elements may be any number greater than or equal to 3.

As described above, the audio reproduction apparatus 10 according to Embodiment 1 can localize predetermined sound from only the linearly arranged speaker array 12 to the listener's ear, without using binaural recording. The audio reproduction apparatus 10 according to Embodiment 1 thus allows the listener 13 to fully enjoy a stereophonic sound field even in a space where speakers cannot be arranged three-dimensionally.

Although Embodiment 1 describes the case where the number of input audio signals is 1 and the sound is localized to the right ear of the listener, the sound may be localized to the left ear, and the number of input audio signals may be greater than 1. In the case where the number of input audio signals is greater than 1, the sounds of the plurality of input audio signals may be localized to the different ears of the listener 13.

Figure 10:
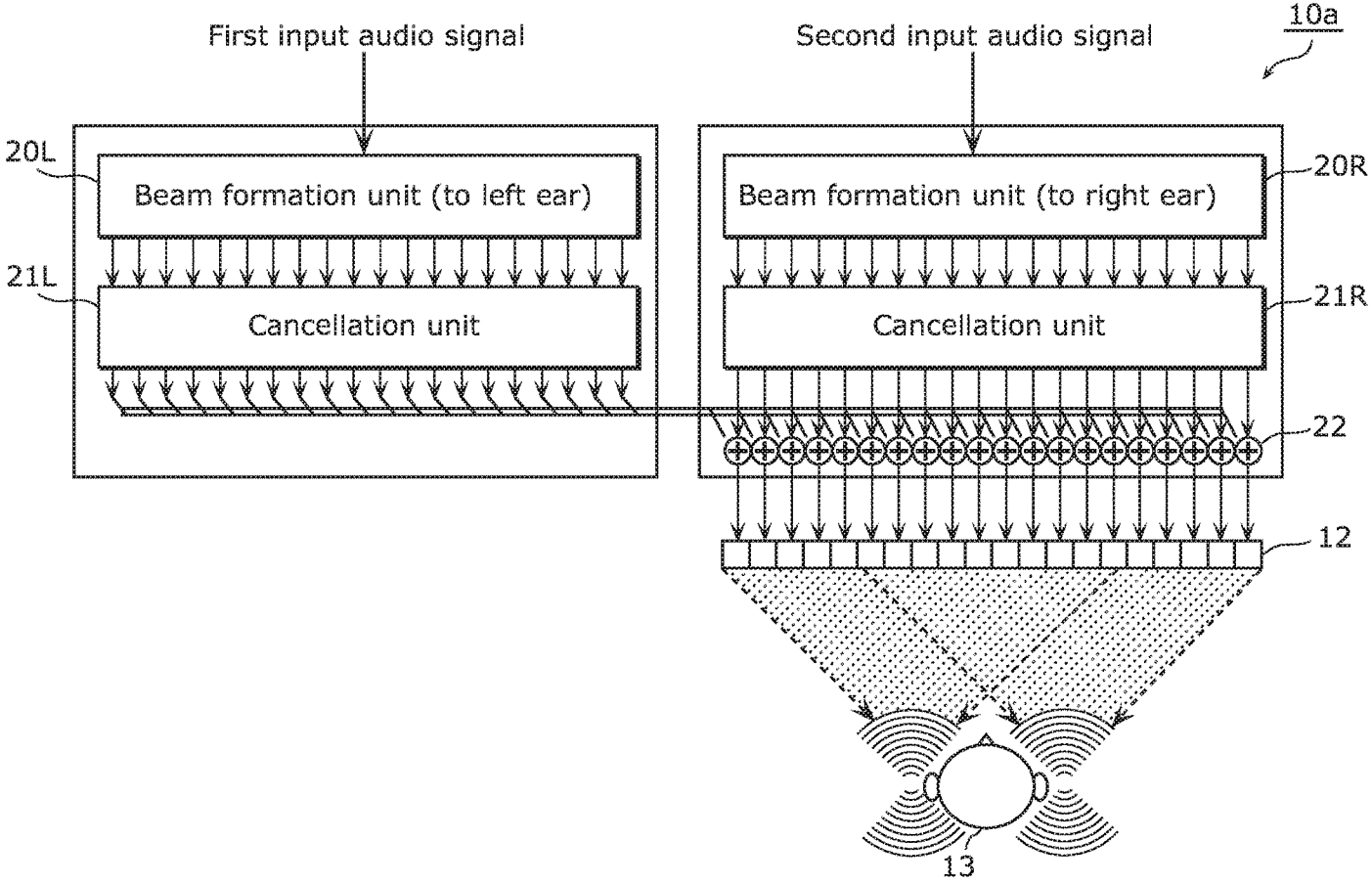
FIG. 10 is a diagram illustrating an example of the structure of the audio reproduction apparatus in the case where the number of input audio signals is 2.

FIG. 10 is a diagram illustrating an example of the structure of the audio reproduction apparatus in the case where the number of input audio signals is 2. An audio reproduction apparatus 10*a* illustrated in FIG. 10 receives two signals, namely, a first input audio signal and a second input audio signal.

The audio reproduction apparatus 10*a* performs the beam formation process and the crosstalk cancellation process on each of the first input audio signal and the second input audio signal.

In detail, the first audio signal undergoes the beam formation process by a beam formation unit 20L so that the reproduced sound localizes to the left ear of the listener 13, and further undergoes the crosstalk cancellation process by a cancellation unit 21L. Likewise, the second audio signal undergoes the beam formation process by a beam formation unit 20R so that the reproduced sound localizes to the right ear of the listener 13, and further undergoes the crosstalk cancellation process by a cancellation unit 21R.

An addition unit 22 adds the signals after the beam formation process and the crosstalk cancellation process for each channel. The added signals are output (reproduced) from the respective speaker elements of the speaker array 12.

Figure 11:
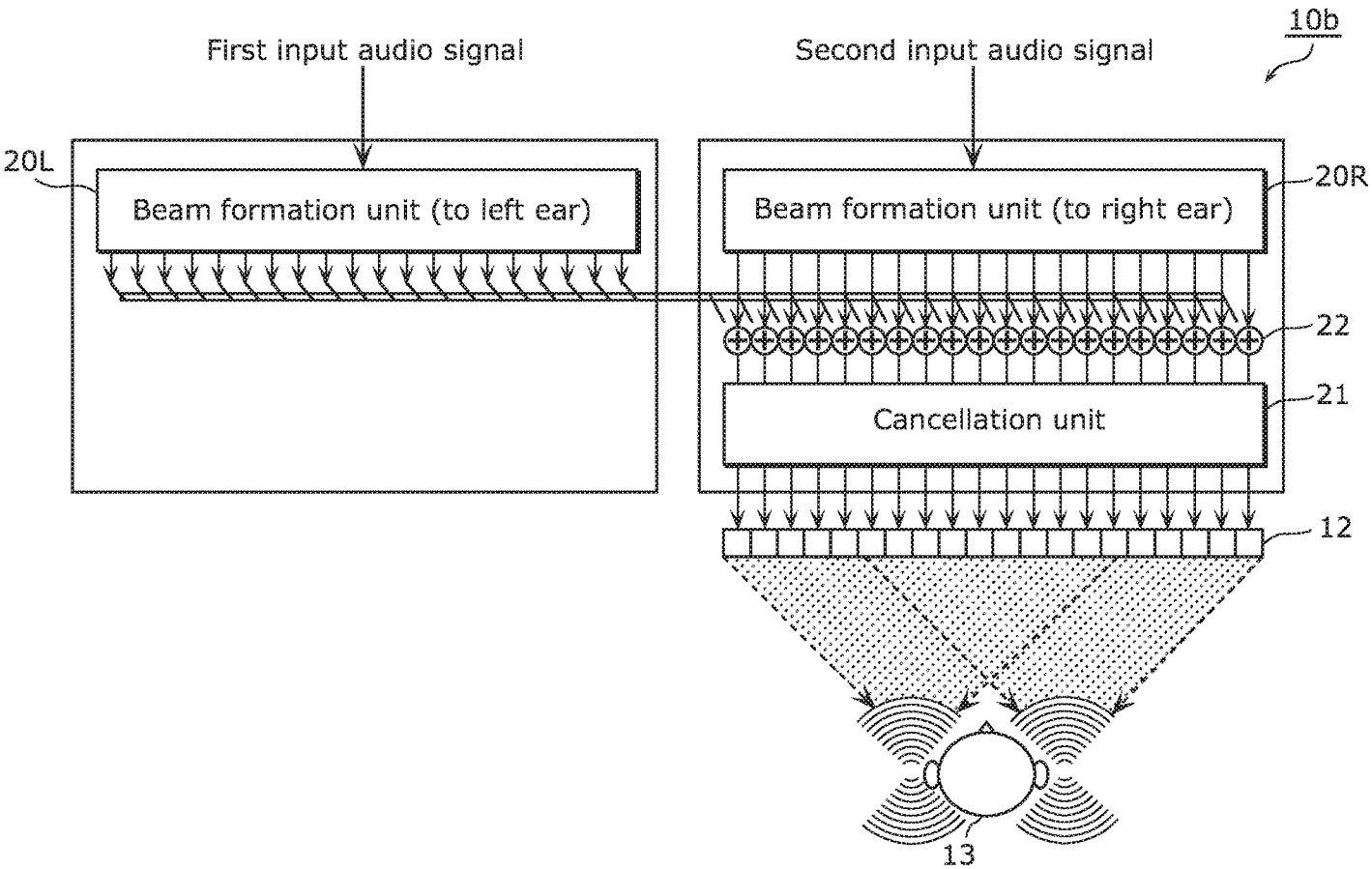
FIG. 11 is a diagram illustrating another example of the structure of the audio reproduction apparatus in the case where the number of input audio signals is 2.

The addition process may be performed before the cancellation process by the cancellation unit 21, as in an audio reproduction apparatus 10*b* in FIG. 11. The addition process may be performed on the filtered signals (the band signals after the process by the position/band-specific filter group 32 and before the process by the band synthesis filter group 33 in the beam formation units 20L and 20R), though not illustrated.

By doing so, the crosstalk cancellation process by the cancellation unit 21 or the process by the band synthesis filter group 33 is completed in one operation. This reduces computation.

Although Embodiment 1 describes the case where the crosstalk cancellation process follows the beam formation process, i.e. the cancellation unit 21 performs the crosstalk cancellation process on the N signals resulting from the beam formation process on the input audio signal for each of the N/2 pairs, the beam formation process may be performed after the crosstalk cancellation process.

Figure 12:
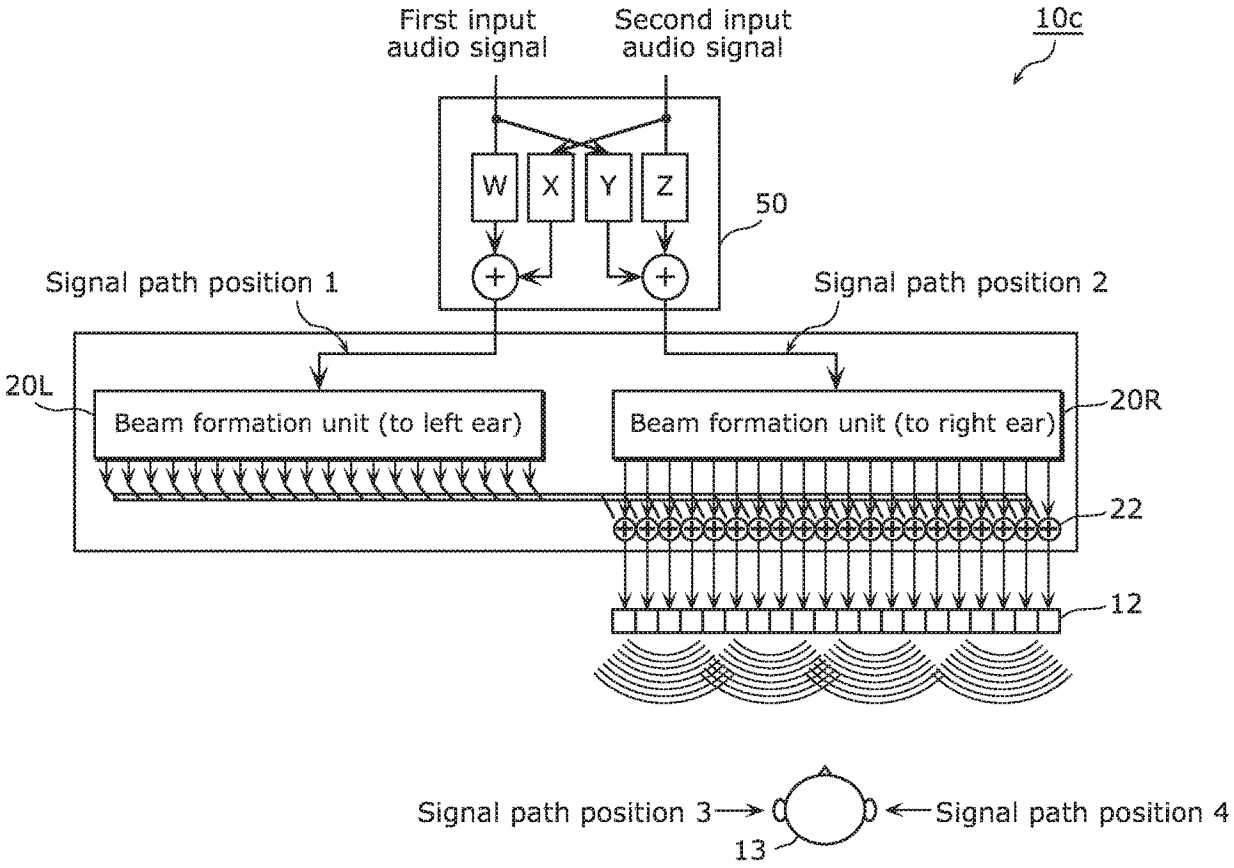
FIG. 12 is a diagram illustrating an example of the structure of the audio reproduction apparatus in the case where a beam formation process is performed after a crosstalk cancellation process.

FIG. 12 is a diagram illustrating an example of the structure of the audio reproduction apparatus in the case where the beam formation process is performed after the crosstalk cancellation process. An audio reproduction apparatus 10*c* illustrated in FIG. 12 receives two input audio signals.

A cancellation unit 50 in the audio reproduction apparatus 10*c* multiplies the two input audio signals by four transfer functions (W, X, Y, Z). The following describes how to find W, X, Y, and Z.

FIG. 12 illustrates signal path positions 1, 2, 3, and 4. The signal path positions 1 and 2 are the positions in an intermediate stage of signal processing (immediately before the beam formation process). The signal path position 3 is the position of the left ear of the listener, and the signal path position 4 is the position of the right ear of the listener.

Let hBFL be the transfer function from the signal path position 1 to the signal path position 3, hBCL be the transfer function from the signal path position 1 to the signal path position 4, hBCR be the transfer function from the signal path position 2 to the signal path position 3, and hBFR be the transfer function from the signal path position 2 to the signal path position 4. In this case, the matrix M and the elements W, X, Y, and Z of the inverse matrix $M^{-1}$ of the matrix M have the following relationship.

[Math. 2]

$$M^{-1} = \begin{pmatrix} W & X \\ Y & Z \end{pmatrix} \text{ when } M = \begin{pmatrix} hBFL & hBCL \\ hBCR & hBFR \end{pmatrix}.$$

In the structure of the audio reproduction apparatus 10*c*, the transfer functions of the signals input to the beam formation units 20L and 20R are measured or calculated beforehand. The transfer functions mentioned here are the transfer functions when the signals input to the beam formation units 20L and 20R and subjected to the beam formation process are output from the speaker array 12 and eventually reach the listener's ears. The inverse matrix of the matrix having these transfer functions as elements is determined, and the determined inverse matrix is used to perform the crosstalk cancellation process before the beam formation process. Thus, the crosstalk cancellation process is performed before the beam formation process.

As described above, the cancellation unit 50 performs the crosstalk cancellation process on the input audio signals, based on the transfer functions when the signals input to the beam formation units 20L and 20R are output from the speaker array 12 as reproduced sound and reach the listener's ears. The beam formation units 20L and 20R perform the beam formation process on the input audio signals that have undergone the crosstalk cancellation process, to generate N channel signals.

As is clear from the comparison between FIGS. 8 and 12, when the crosstalk cancellation process precedes the beam formation process, the crosstalk cancellation process only needs to be performed on one pair of signals. This reduces computation.

Embodiment 2

Figure 13:
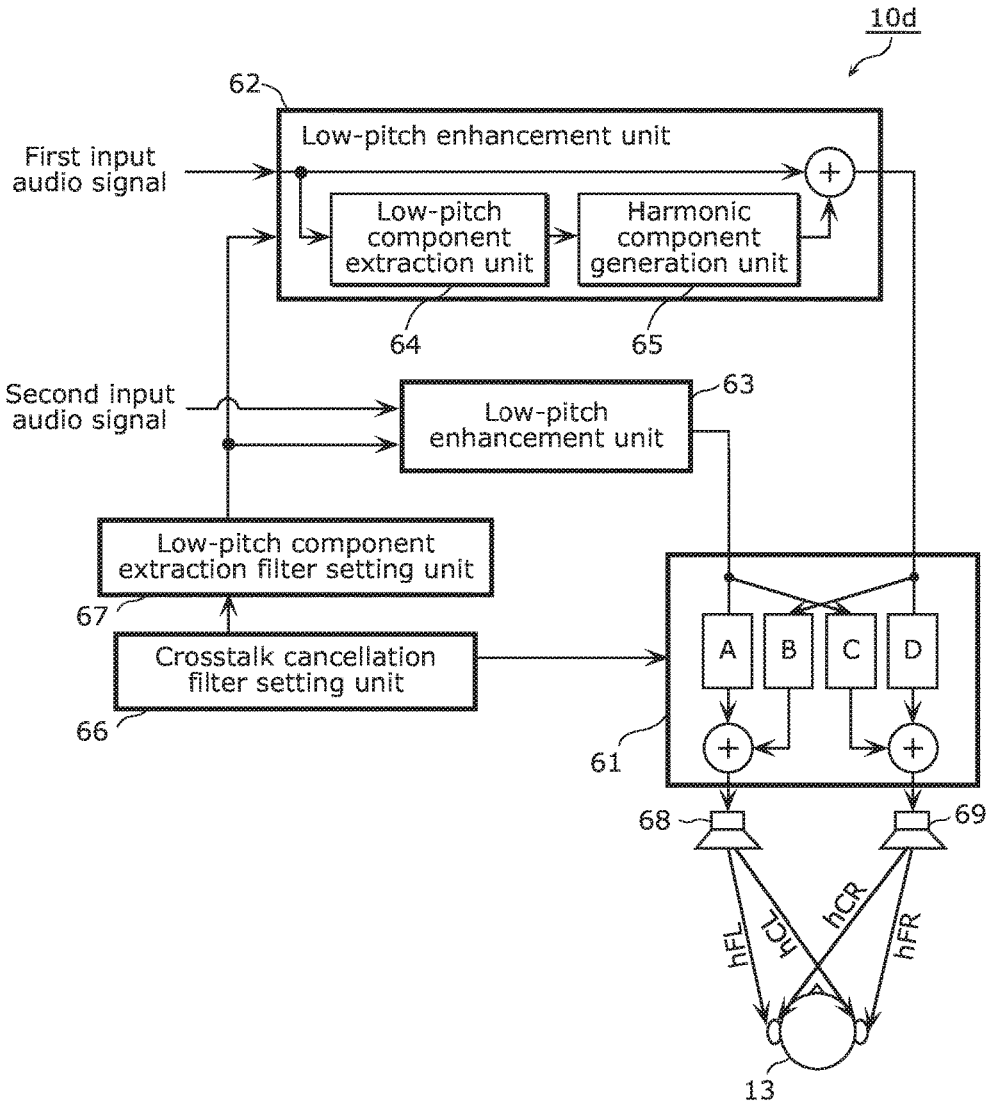
FIG. 13 is a diagram illustrating the structure of an audio reproduction apparatus according to Embodiment 2.

An audio reproduction apparatus according to Embodiment 2 is described below, with reference to drawings. FIG. 13 is a diagram illustrating the structure of the audio reproduction apparatus according to Embodiment 2.

As illustrated in FIG. 13, an audio reproduction apparatus 10*d* includes a signal processing unit (a cancellation unit 61, a low-pitch enhancement unit 62, and a low-pitch enhancement unit 63), a crosstalk cancellation filter setting unit 66, a low-pitch component extraction filter setting unit 67, a left speaker element 68, and a right speaker element 69. The low-pitch enhancement unit 62 includes a low-pitch component extraction unit 64 and a harmonic component generation unit 65. The low-pitch enhancement unit 63 equally includes a low-pitch component extraction unit and a harmonic component generation unit, though their illustration and description are omitted.

The signal processing unit includes the cancellation unit 61, the low-pitch enhancement unit 62, and the low-pitch enhancement unit 63. The signal processing unit converts a first audio signal and a second audio signal into a left channel signal and a right channel signal.

The left speaker element 68 outputs the left channel signal as reproduced sound. The right speaker element 69 outputs the right channel signal as reproduced sound.

The cancellation unit 61 performs a cancellation process on the first input audio signal to which a harmonic component has been added by the low-pitch enhancement unit 62 and the second input audio signal to which a harmonic component has been added by the low-pitch enhancement unit 63, to generate the left channel signal and the right channel signal. The cancellation process is a process of preventing the reproduced sound output from the right speaker element 69 from reaching the left ear of the listener 13, and preventing the reproduced sound output from the left speaker element 68 from reaching the right ear of the listener 13.

The low-pitch enhancement unit 62 adds the harmonic component of the low-frequency part of the first input audio signal, to the first input audio signal.

The low-pitch enhancement unit 63 adds the harmonic component of the low-frequency part of the second input audio signal, to the second input audio signal.

The low-pitch component extraction unit 64 extracts the low-frequency part (low-pitch component) enhanced by the low-pitch enhancement unit 62.

The harmonic component generation unit 65 generates the harmonic component of the low-pitch component extracted by the low-pitch component extraction unit 64.

The crosstalk cancellation filter setting unit 66 sets the filter coefficient of each crosstalk cancellation filter included in the cancellation unit 61.

The low-pitch component extraction filter setting unit 67 sets the filter coefficient of each low-pitch component extraction filter included in the low-pitch component extraction unit 64.

Although the low-pitch enhancement process and the cancellation process are performed on two input audio signals (the first input audio signal and the second input audio signal) in Embodiment 2, the number of input audio signals may be 1.

The operation of the audio reproduction apparatus 10*d* having the above-mentioned structure is described below.

First, the low-pitch enhancement units 62 and 63 receive the first input audio signal and the second input audio signal, respectively. The low-pitch enhancement units 62 and 63 each utilize the missing fundamental phenomenon.

When a human hears sound that lacks a low pitch (fundamental), he or she can still perceive the low pitch (fundamental) if the harmonic component of the low-pitch (fundamental) is present. This is the missing fundamental phenomenon.

In Embodiment 2, the low-pitch enhancement units 62 and 63 each perform signal processing utilizing the missing fundamental phenomenon, in order to auditorily recover the low-pitch component of the first or second input audio signal which attenuates due to the crosstalk cancellation process.

In detail, in each of the low-pitch enhancement units 62 and 63, the low-pitch component extraction unit 64 extracts the signal of the frequency band that attenuates due to the crosstalk cancellation process, and the harmonic component generation unit 65 generates the harmonic component of the low-pitch component extracted by the low-pitch component extraction unit 64. The method of generating the harmonic component by the harmonic component generation unit 65 may be any conventionally known method.

The signals processed by the low-pitch enhancement units 62 and 63 are input to the cancellation unit 61 and subjected to the crosstalk cancellation process. The crosstalk cancellation process is the same as the process described in the section "Underlying Knowledge Forming Basis of the Present Disclosure" and Embodiment 1.

Here, the filter coefficient of each crosstalk cancellation filter used in the cancellation unit 61 varies depending on the speaker interval, the speaker characteristics, the positional relationship between the speaker and the listener, etc. The crosstalk cancellation filter setting unit 66 accordingly sets an appropriate filter coefficient.

Which band of each of the first and second input audio signals the attenuated low-pitch component belongs to can be determined based on the characteristics of the crosstalk cancellation filter (see PTL 1 as an example). The low-pitch component extraction filter setting unit 67 accordingly sets the low-pitch component extraction filter coefficient, in order to extract the harmonic component of the attenuated band.

As described above, in the audio reproduction apparatus 10*d* according to Embodiment 2, the low-pitch enhancement units 62 and 63 add the harmonic components of the low-frequency signals attenuated due to the crosstalk cancellation process by the cancellation unit 61, respectively to the first and second input audio signals. The audio reproduction apparatus 10*d* can thus perform the crosstalk cancellation process with high sound quality.

The audio reproduction apparatus described in Embodiment 1 may include the low-pitch enhancement unit 62 (63). In this case, the signal processing unit 11 in Embodiment 1 further includes the low-pitch enhancement unit 62 (63) that adds the harmonic component of the low-frequency signal of the input audio signal before the crosstalk cancellation process, to the input audio signal.

Embodiment 3

Figure 14:
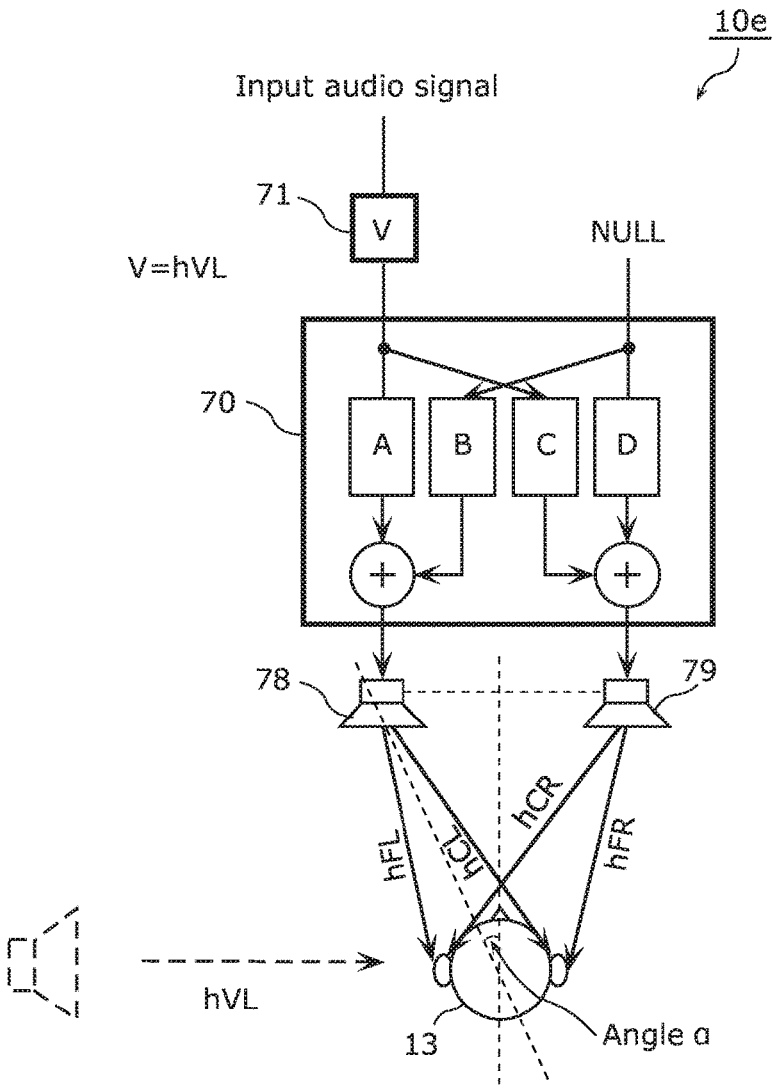
FIG. 14 is a diagram illustrating the structure of an audio reproduction apparatus according to Embodiment 3.

An audio reproduction apparatus according to Embodiment 3 is described below, with reference to drawings. FIG. 14 is a diagram illustrating the structure of the audio reproduction apparatus according to Embodiment 3.

As illustrated in FIG. 14, an audio reproduction apparatus 10*e* includes a signal processing unit (a crosstalk cancellation unit 70 and a virtual sound image localization filter 71), a left speaker element 78, and a right speaker element 79.

The signal processing unit (the crosstalk cancellation unit 70 and the virtual sound image localization filter 71) converts an input audio signal into a left channel signal and a right channel signal. In detail, the input audio signal processed by the virtual sound image localization filter 71 is converted into the left channel signal and the right channel signal.

The left speaker element 78 outputs the left channel signal as reproduced sound. The right speaker element 79 outputs the right channel signal as reproduced sound.

The virtual sound image localization filter 71 is designed so that the sound of the input audio signal (the sound represented by the input audio signal) is heard from the left of the listener 13, i.e. the sound of the input audio signal is localized to the left side of the listener 13. In other words, the virtual sound image localization filter 71 is designed so that the sound of the input audio signal is localized to a predetermined position and the enhanced sound is perceived at the position of one ear of the listener 13 facing the left speaker element 78 and the right speaker element 79.

The crosstalk cancellation unit 70 performs, on the input audio signal, a cancellation process of preventing the sound of the input audio signal from being perceived in the other ear of the listener 13, thus generating the left channel signal and the right channel signal. In other words, the crosstalk cancellation unit 70 is designed so that the reproduced sound output from the left speaker element 78 is not perceived in the right ear and the reproduced sound output from the right speaker element 79 is not perceived in the left ear.

The operation of the audio reproduction apparatus 10*e* having the above-mentioned structure is described below.

First, the virtual sound image localization filter 71 processes the input audio signal. The virtual sound image localization filter 71 is a filter designed so that the sound of the input audio signal is heard from the left of the listener 13. In detail, the virtual sound image localization filter 71 is a filter representing the transfer function of sound from a sound source placed at the left of the listener 13 to the left ear of the listener 13.

The input audio signal processed by the virtual sound image localization filter 71 is input to one input terminal of the crosstalk cancellation unit 70. Meanwhile, a null signal (silence) is input to the other input terminal of the crosstalk cancellation unit 70.

The crosstalk cancellation unit 70 performs the crosstalk cancellation process. The crosstalk cancellation process includes a process of multiplication by transfer functions A, B, C, and D, a process of addition of the signal multiplied by the transfer function A and the signal multiplied by the transfer function B, and a process of addition of the signal multiplied by the transfer function C and the signal multiplied by the transfer function D. In other words, the crosstalk cancellation process is a process using the inverse matrix of a 2×2 matrix whose elements are the transfer functions of sounds output from the left speaker element 78 and the right speaker element 79 and reaching the respective ears of the listener 13. This crosstalk cancellation process is the same as the process described in the section "Underlying Knowledge Forming Basis of the Present Disclosure" and Embodiment 1. The signals which have undergone the crosstalk cancellation process by the crosstalk cancellation unit 70 are output from the left speaker element 78 and the right speaker element 79 to the space as reproduced sound, and the output reproduced sounds reach the ears of the listener 13.

Since the null signal (silence) is input to the other input terminal of the crosstalk cancellation unit 70 and the sound to the right ear of the listener 13 is crosstalk-canceled by the crosstalk cancellation unit 70, the listener 13 perceives the sound of the input audio signal only in his or her left ear.

Although the virtual sound image localization filter 71 in Embodiment 3 is designed so that the sound is localized just beside the listener 13, this is not a limitation.

The sound intended to be created in Embodiment 3 is a whispering sound (whisper) in the left ear of the listener 13. Such sound is usually heard from approximately just beside the listener 13 or its vicinity, and it is unusual to hear such sound at least from the front.

Therefore, the position (predetermined position) to which the sound is localized is desirably on the left side (left rear side) of the straight line connecting the left speaker element 78 and the listener 13 (the straight line forming angle $\alpha$ with the perpendicular line from the position of the listener 13 to the line connecting the left speaker element 78 and the right speaker element 79), when the listener 13, the left speaker element 78, and the right speaker element 79 are viewed from above (seen vertically) as in FIG. 14. In other words, the predetermined position is desirably in the same area as one ear of the listener 13 from among two areas separated by the straight line connecting the position of the listener 13 and one of the left speaker element 78 and the right speaker element 79 that corresponds to the ear when viewed from above.

In other words, the virtual sound image localization filter 71 is desirably a filter designed so that the sound of the input audio signal is localized to a position where the listener 13 cannot see the mouth of the whisperer, that is, approximately just beside the listener 13 or its vicinity. Here, "approximately just beside" means that the straight line connecting the predetermined position and the position of the listener 13 is approximately in parallel with the straight line connecting the left speaker element 78 and the right speaker element 79 when viewed from above.

The crosstalk cancellation unit 70 does not necessarily need to perform such a crosstalk cancellation process that localizes no sound at all to the right ear of the listener 13 (so that the signal is 0). The term "crosstalk cancellation" is used to suggest that such sound (voice) whispered in the left ear of the listener 13 does not approximately reach the right ear of the listener 13. Accordingly, sound sufficiently smaller than that of the left ear of the listener 13 may be localized to the right ear of the listener 13.

Although the audio reproduction apparatus 10*e* in Embodiment 3 is designed so that the sound of the input audio signal is perceived in the left ear of the listener 13, the audio reproduction apparatus 10*e* may be designed so that the sound of the input audio signal is perceived in the right ear of the listener 13. To cause the sound of the input audio signal to be perceived in the right ear of the listener 13, the virtual sound image localization filter 71 is designed so that the input audio signal is heard from the right of the listener 13, and the input audio signal is input to the other input terminal of the crosstalk cancellation unit 70 (the terminal to which the null signal is input in the above description). Meanwhile, the null signal is input to the one input terminal of the crosstalk cancellation unit 70.

Figure 15:
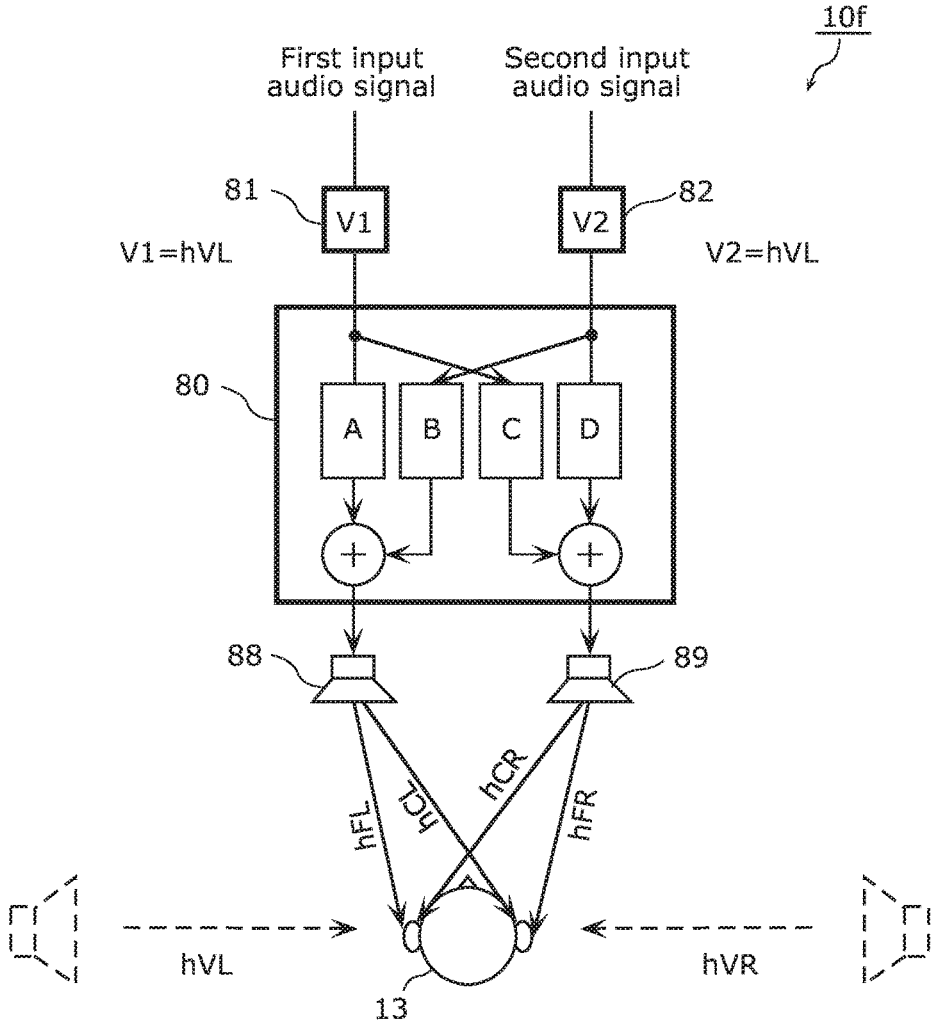
FIG. 15 is a diagram illustrating the structure of the audio reproduction apparatus in the case of using two input audio signals according to Embodiment 3.

In the case of simultaneously localizing sound to the right ear and left ear of the listener 13, the audio reproduction apparatus has the structure illustrated in FIG. 15. FIG. 15 is a diagram illustrating the structure of the audio reproduction apparatus in the case of using two input audio signals.

In an audio reproduction apparatus 10*f* illustrated in FIG. 15, a virtual sound image localization filter 81 processes a first input audio signal, and a virtual sound image localization filter 82 processes a second input audio signal.

The virtual sound image localization filter 81 is a filter designed so that the sound of the input audio signal to the filter is heard from the left of the listener 13. The virtual sound image localization filter 82 is a filter designed so that the sound of the input audio signal to the filter is heard from the right of the listener 13.

The first input audio signal processed by the virtual sound image localization filter 81 is input to one input terminal of a crosstalk cancellation unit 80. The second input audio signal processed by the virtual sound image localization filter 82 is input to the other input terminal of the crosstalk cancellation unit 80. The crosstalk cancellation unit 80 has the same structure as the crosstalk cancellation unit 70. The signals which have undergone the crosstalk cancellation process by the crosstalk cancellation unit 80 are output from a left speaker element 88 and a right speaker element 89 to the space as reproduced sound, and the output reproduced sounds reach the ears of the listener 13.

Although Embodiment 3 describes the crosstalk cancellation unit 70 and the virtual sound image localization filter 71 as separate structural elements for the sake of simplicity, the audio reproduction apparatus 10*e* may include a filter operation unit (a structural element combining the crosstalk cancellation unit 70 and the virtual sound image localization filter 71) that virtually localizes a sound image and performs signal processing so that the sound is perceived only in one ear of the listener 13.

As described above, the audio reproduction apparatus 10*e* or 10*f* according to Embodiment 3 allows the listener 13 to perceive sound (voice) as if someone is whispering in the ear of the listener 13.

Embodiment 4

Figure 16:
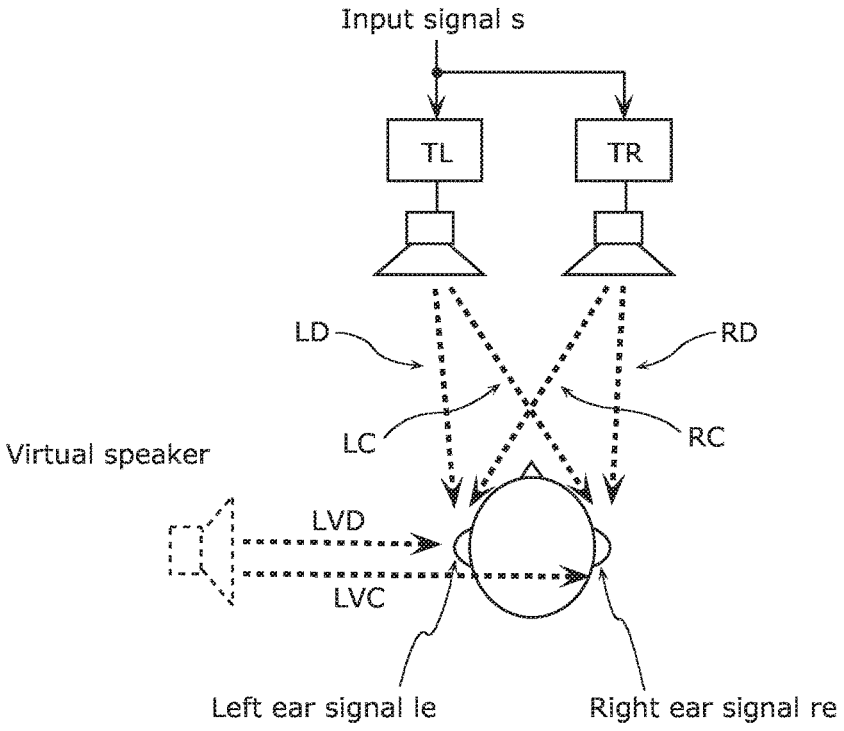
FIG. 16 is a diagram illustrating the structure of an audio reproduction apparatus in the case of using two input audio signals according to Embodiment 4.

An audio reproduction apparatus according to Embodiment 4 is described below, with reference to drawings. FIG. 16 is a diagram illustrating the structure of the audio reproduction apparatus according to Embodiment 4.

FIG. 16 is a diagram illustrating signal flow until an acoustic signal reaches a listener's ear according to Embodiment 4. In detail, FIG. 16 illustrates signal flow when the sense of reproduction in the ear is increased or decreased by controlling the strength of crosstalk cancellation.

In FIG. 16, LVD denotes the transfer function of sound from a virtual speaker (virtual sound source) to the left ear of the listener, and LVC denotes the transfer function of sound from the same virtual speaker to the right ear of the listener.

As illustrated in FIG. 16, the virtual speaker is placed on the light side of the listener. Hence, the transfer function LVD is an example of a first transfer function of sound from a virtual speaker to a listener's first ear (left ear) nearer the virtual speaker, and the transfer function LVC is an example of a second transfer function of sound from the virtual speaker to the listener's second ear (right ear) opposite to the first ear.

Formula 1 indicates the target characteristics of the ear signal reaching the listener's ear in the signal flow illustrated in FIG. 16. In detail, Formula 1 indicates such target characteristics according to which the signal obtained by multiplying the input signal s by the transfer function LVD, i.e. such a signal that makes the input signal appear to come from the direction of approximately 90 degrees of the listener, reaches the left ear, and the signal obtained by multiplying the input signal s by the transfer function LVC, i.e. such a signal that makes the input signal appear to come from the direction of approximately 90 degrees of the listener, reaches the right ear.

[Math. 3]

$$\begin{pmatrix} s \times LVD \times \alpha \\ s \times LVC \times \beta \end{pmatrix} = \begin{pmatrix} LD & RC \\ LC & RD \end{pmatrix} \times \begin{pmatrix} TL \\ TR \end{pmatrix} \times (s). \quad \text{(Formula 1)}$$

Here, α and β in the left side are parameters for controlling the strength of the sense of reproduction in the left ear. In detail, α is an example of a first parameter by which the first transfer function is multiplied, and β is an example of a second parameter by which the second transfer function is multiplied.

Rearranging Formula 1 yields the stereophonic transfer functions [TL, TR] to be the result of multiplying the inverse matrix of the determinant of the spatial acoustic transfer functions by the constant sequence [LVD×α, LVC×β], as shown in Formula 2.

[Math. 4]

$$\begin{pmatrix} TL \\ TR \end{pmatrix} = \begin{pmatrix} LD & RC \\ LC & RD \end{pmatrix}^{-1} \times \begin{pmatrix} LVD \times \alpha \\ LVC \times \beta \end{pmatrix}. \quad \text{(Formula 2)}$$

In the case where a is sufficiently greater than β, that is, in the case where the loudness of sound reaching the left ear is sufficiently greater than the loudness of sound reaching the right ear, the sense of reproduction in the left ear is strong. This coincides with an actual phenomenon that whispering voice in the left ear does not reach the right ear, e.g. a phenomenon that buzzing sound of a mosquito heard by the left ear does not reach the right ear.

In the case where α and β are approximately equal, that is, in the case where the loudness of sound reaching the left ear is approximately equal to the loudness of sound reaching the right ear, the sense of reproduction in the left ear is weak. This coincides with an actual phenomenon that voice or sound generated far on the left side reaches the right ear, too.

Figure 17:
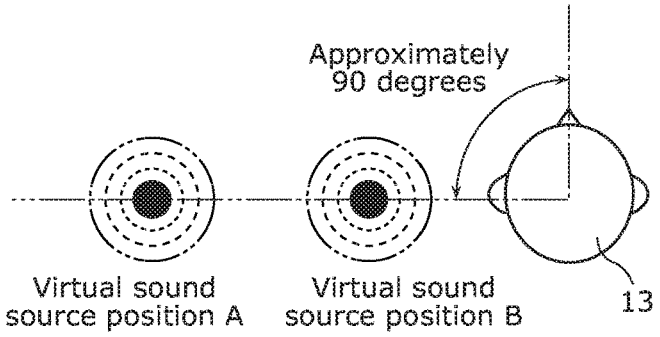
FIG. 17 is a diagram illustrating the position of a virtual sound source in the direction of approximately 90 degrees of a listener according to Embodiment 4.

By appropriately controlling α and β, it is possible to produce, for example, such an acoustic effect that makes sound appear to approach from far away. This is described below, with reference to FIG. 17. FIG. 17 is a diagram illustrating the position of a virtual sound source in the direction of approximately 90 degrees of a listener according to Embodiment 4.

As illustrated in FIG. 17, virtual sound source positions A and B each indicate the position of a virtual sound source in the direction of approximately 90 degrees of the listener 13. Here, "approximately 90 degrees" is the angle with respect to the front (0 degree) of the listener 13. The direction of approximately 90 degrees of the listener 13 is therefore the direction corresponding to approximately just beside the listener 13, which is to the left or right of the listener 13. The virtual sound source position A is farther from the listener 13 than the virtual sound source position B.

Let R be the ratio of α and β (α/β). In this embodiment, R is set to a first value close to 1 when the distance between the virtual sound source and the listener 13 is a first distance, and set to a second value greater than the first value when the distance between the virtual sound source and the listener 13 is a second distance that is shorter than the first distance. In other words, R is set to the first value close to 1 when the virtual sound source and the listener 13 are farther from each other, and set to the second value (including infinity) greater than the first value when the virtual sound source and the listener 13 are nearer each other.

For example, in the case where the virtual sound source is placed at the virtual sound source position A in FIG. 17 at the start of sound, the ratio of α and β is controlled to be approximately 1. In the case where the virtual sound source is placed at the virtual sound source position B after a predetermined time, α is set to be sufficiently greater than β. Such an acoustic effect that makes sound appear to approach from far away can be produced in this way.

Typically, in the case where the virtual sound source is at approximately 90 degrees of the listener 13 as in FIG. 17, the input signal is processed using such transfer functions intended to place the virtual sound source at approximately 90 degrees, while the sense of perspective from the listener 13 is controlled by the sound volume. In this embodiment, on the other hand, α and β are controlled to realize a normally experienced acoustic effect that, in the case where the sound source has approached to the ear, the ear perceives such loud sound that makes the sound of the opposite ear not perceptible.

Likewise, such an acoustic effect that makes sound appear to recede into the distance can be produced by setting α to be sufficiently greater than β at the start of sound and, after a predetermined time, setting the ratio of α and β to be approximately 1.

Since LVD and LVC are the transfer functions intended to place the virtual speaker (virtual sound source) at approximately 90 degrees, the direction of the above-mentioned "far" or "into the distance" is the direction of approximately 90 degrees of the listener. This direction of "far" or "into the distance" can be changed to a desired direction by changing the direction in which the virtual speaker (virtual sound source) is placed, i.e. by changing LVD and LVC to such transfer functions intended to place the virtual speaker (virtual sound source) in the desired direction.

As described above, in the audio reproduction apparatus according to this embodiment, in the filter process using the first transfer function of sound from the virtual speaker placed to one side of the listener 13 to the first ear of the listener nearer the virtual speaker, the second transfer function of sound from the virtual sound source to the second ear opposite to the first ear, the first parameter α by which the first transfer function is multiplied, and the second parameter β by which the second transfer function is multiplied, the signal processing unit controls the first parameter α and the second parameter β. The sense of perspective from the sound source position can be controlled in this way.

Although the virtual speaker is placed at approximately 90 degrees of the listener in the example in FIGS. 16 and 17, the position of the virtual speaker is not limited to approximately 90 degrees. Although the above describes the process relating to the left ear, the process may relate to the right ear. Alternatively, the process relating to the left ear and the process relating to the right ear may be simultaneously performed to produce the sense of reproduction in both ears.

Figure 18:
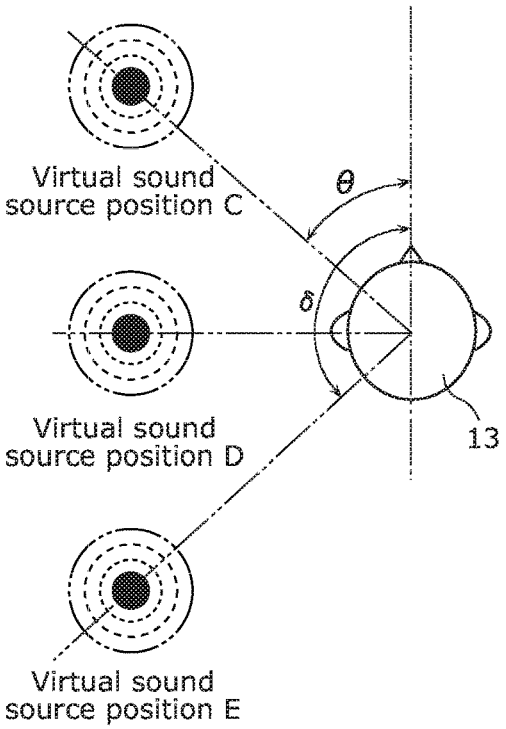
FIG. 18 is a diagram illustrating the position of a virtual sound source on one side of a listener according to Embodiment 4.

While the above embodiment describes the process of producing the sense of perspective between the virtual sound source and the listener 13, an example of producing the passage of the virtual sound source on one side of the listener 13 is described below with reference to FIG. 18. FIG. 18 is a diagram illustrating the position of the virtual sound source on one side of the listener according to Embodiment 4.

As illustrated in FIG. 18, virtual sound source positions C, D, and E each indicate the position of the virtual sound source placed on the side of the listener 13.

Let R be the ratio of α and β(α/β). In this embodiment, R is set to a value greater than 1 when the position of the virtual sound source is approximately 90 degrees with respect to the front of the listener 13, and set to be closer to 1 when the position of the virtual sound source deviates more from approximately 90 degrees with respect to the front of the listener 13. In other words, R is set to a value (including infinity) greater than 1 when the virtual sound source is positioned approximately just beside the listener 13, and set to be closer to 1 when the virtual sound source deviates more from approximately just beside the listener 13.

For example, in the case where the virtual sound source is placed at the virtual sound source position C in FIG. 18 at the start of sound, the signal of the sound is processed with transfer functions intended to place the virtual sound source at approximately θ degrees ($0 \leq \theta < 90$). In this stage, the ratio R of α and β(=α/β) is set to a value (X) close to 1.

In the case where the virtual sound source is placed at the virtual sound source position D after a predetermined time, the signal of the sound is processed with transfer functions intended to place the virtual sound source at approximately 90 degrees, and also the ratio R of α and β is set to a value greater than X.

In the case where the virtual sound source is further placed at the virtual sound source position E after a predetermined time, the signal of the sound is processed with transfer functions intended to place the virtual sound source at approximately δ degrees, and also the ratio R of α and β is set to a value (Y) close to 1. X and Y may be the same value. This adds a sense of realism to such an acoustic effect that makes sound appear to pass on the side of the listener 13.

Typically, in the case where the virtual sound source is at approximately θ degrees of the listener 13, the input signal is processed using such transfer functions intended to place the virtual sound source at approximately θ degrees. In the case where the virtual sound source is at approximately 90 degrees of the listener 13, the input signal is processed using such transfer functions intended to place the virtual sound source at approximately 90 degrees. In the case where the virtual sound source is at approximately δ degrees ($90<\delta\leq180$) of the listener 13, the input signal is processed using such transfer functions intended to place the virtual sound source at approximately δ degrees. Meanwhile, the sound volume is controlled depending on the distance from the listener 13.

In this embodiment, on the other hand, α and β are controlled to enhance, when the sound source passes on the side of the listener 13, the sense of the sound source passing just beside the listener 13. The angles θ and δ illustrated in FIG. 18 are merely an example, and are not requirements in the present disclosure.

Embodiment 5

While Embodiments 1 to 4 each describe an audio reproduction apparatus that localizes sound to a listener's ear, the disclosed technology can also be implemented as a game apparatus that produces the enjoyment of a game by acoustic effects. The game apparatus according to the present disclosure thus includes, for example, any of the audio reproduction apparatuses according to Embodiments 1 to 4.

For example, the signal processing unit 11 in Embodiments 1 to 4 corresponds to an acoustic processing unit included in a game apparatus according to the present disclosure, and the speaker array 12 in Embodiments 1 to 4 corresponds to a sound output unit (speaker) included in the game apparatus according to the present disclosure.

Recent game apparatuses each produce, in a pachinko machine, a slot machine, or the like, the enjoyment of the game by presenting a sense of expectation of the player winning the game to the player through an image display unit installed in the game apparatus.

For example, the game apparatus makes the player recognize that, as the probability of winning the game increases, a person or character which does not appear in the normal state of the game appears on the image display unit, or the colors of the screen change. This heightens the sense of expectation of winning the game, and as a result increases the enjoyment of the game.

Regarding acoustic effects, such game apparatuses that increase the enjoyment of the game by changing the acoustic signal processing method depending on the state of the game have been developed.

For example, PTL 3 discloses the technique of controlling acoustic signals output from a plurality of speakers in coordination with the operation of a variable display unit of a slot machine. This technique varies the acoustic effects by controlling the output levels and phases of the signals output from the plurality of speakers depending on the state of the game (start, stop, prize type).

The conventional technique described in PTL 3, however, coordinates the acoustic effects with the operation of the variable display unit, and cannot produce a sense of expectation of win which is hidden (not visible) in the state of the game.

In view of this, the present disclosure provides a game apparatus that can heighten a sense of expectation of a player winning a game.

According to the present disclosure, a sense of expectation of a player winning a game can be heightened.

A game apparatus according to Embodiment 5 is described below, with reference to drawings.

Figure 19:
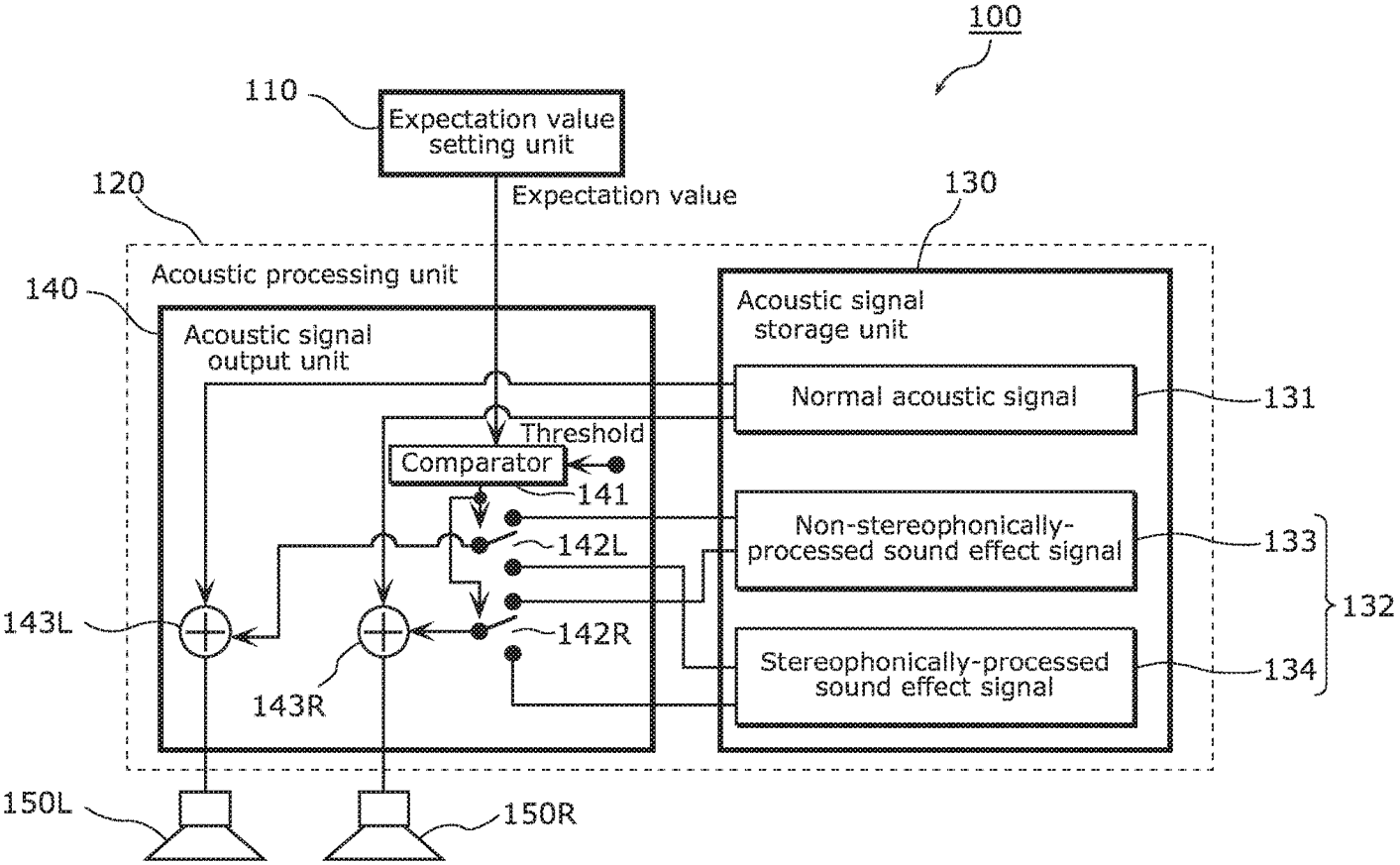
FIG. 19 is a block diagram illustrating an example of the structure of a game apparatus according to Embodiment 5.
Figure 20:
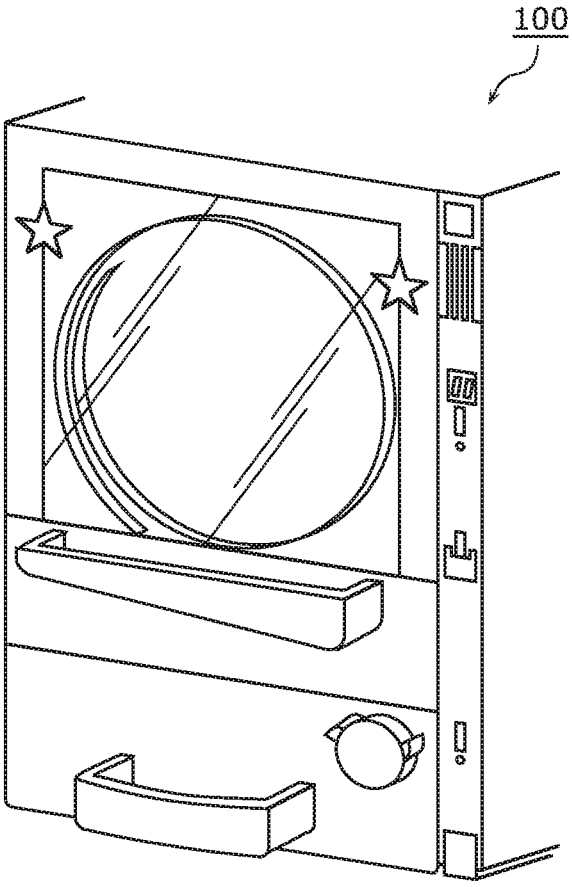
FIG. 20 is an external perspective view of an example of the game apparatus according to Embodiment 5.

FIG. 19 is a block diagram illustrating the structure of a game apparatus 100 according to Embodiment 5. The game apparatus 100 according to Embodiment 5 produces a sense of expectation of a player winning a game by stereophonic technology. For example, the game apparatus 100 is a game machine such as a pachinko machine or a slot machine as illustrated in FIG. 20.

As illustrated in FIG. 19, the game apparatus 100 includes an expectation value setting unit 110, an acoustic processing unit 120, and at least two speakers 150L and 150R. The acoustic processing unit 120 includes an acoustic signal storage unit 130 and an acoustic signal output unit 140.

The following describes the structure and operation of each unit in the game apparatus 100.

The expectation value setting unit 110 sets the expectation value of the player winning the game. In detail, the expectation value setting unit 110 sets such an expectation value that makes the player think he or she will win the game. The detailed structure and operation of the expectation value setting unit 110 will be described later with reference to FIG. 21. In this embodiment, when the set expectation value is higher, the expectation of the player winning the game is higher.

For example, the expectation value setting unit 110 may set the expectation value using a method of generating a state variable representing growing expectation, which has been employed in conventionally widespread game apparatuses to produce a sense of expectation of a player winning a game through an image or electric light.

The acoustic processing unit 120 outputs an acoustic signal corresponding to the expectation value set by the expectation value setting unit 110. In detail, in the case where the expectation value set by the expectation value setting unit 110 is greater than a predetermined threshold, the acoustic processing unit 120 outputs an acoustic signal processed by a filter with stronger crosstalk cancellation performance than in the case where the expectation value is less than the threshold.

As illustrated in FIG. 19, the acoustic processing unit 120 includes the acoustic signal storage unit 130 that stores acoustic signals provided to the player during the game, and the acoustic signal output unit 140 that changes the output acoustic signal depending on the expectation value set by the expectation value setting unit 110.

The acoustic signal storage unit 130 is memory for storing acoustic signals. The acoustic signal storage unit 130 stores a normal acoustic signal 131 and a sound effect signal 132.

The normal acoustic signal 131 is an acoustic signal provided to the player regardless of the state of the game. The sound effect signal 132 is an acoustic signal sporadically provided depending on the state of the game. The sound effect signal 132 includes a non-stereophonically-processed sound effect signal 133 and a stereophonically-processed sound effect signal 134.

Stereophonic processing is such a process that makes sound appear to be heard in the player's ear(s). The stereophonically-processed sound effect signal 134 is an example of a first acoustic signal generated by signal processing with strong crosstalk cancellation performance. The non-stereophonically-processed sound effect signal 133 is an example of a second acoustic signal generated by signal processing with weak crosstalk cancellation performance. The method of generating these sound effect signals will be described later with reference to FIG. 22.

The acoustic signal output unit 140 reads the normal acoustic signal 131 and the sound effect signal 132 from the acoustic signal storage unit 130, and outputs them to the speakers 150L and 150R. As illustrated in FIG. 19, the acoustic signal output unit 140 includes a comparator 141, selectors 142L and 142R, and adders 143L and 143R.

The comparator 141 compares the expectation value set by the expectation value setting unit 110 with the predetermined threshold, and outputs the comparison result to the selectors 142L and 142R. In other words, the comparator 141 determines whether or not the expectation value set by the expectation value setting unit 110 is greater than the predetermined threshold, and outputs the determination result to the selectors 142L and 142R.

The selectors 142L and 142R each receive the comparison result from the comparator 141, and select one of the non-stereophonically-processed sound effect signal 133 and the stereophonically-processed sound effect signal 134. In detail, the selectors 142L and 142R each select the stereophonically-processed sound effect signal 134 in the case where the expectation value is greater than the threshold, and select the non-stereophonically-processed sound effect signal 133 in the case where the expectation value is less than the threshold.

The selector 142L outputs the selected sound effect signal to the adder 143L, and the selector 142R outputs the selected sound effect signal to the adder 143R.

The adders 143L and 143R each add the normal acoustic signal 131 and the sound effect signal selected by the selector 142L or 142R, and output the resulting signal to the corresponding one of the speakers 150L and 150R.

Thus, in the case where the expectation value set by the expectation value setting unit 110 is less than the predetermined threshold, the acoustic signal output unit 140 reads the non-stereophonically-processed sound effect signal 133 from the acoustic signal storage unit 130, adds the non-stereophonically-processed sound effect signal 133 to the normal acoustic signal 131, and outputs the resulting signal. In the case where the expectation value set by the expectation value setting unit 110 is greater than the predetermined threshold, on the other hand, the acoustic signal output unit 140 reads the stereophonically-processed sound effect signal 134 from the acoustic signal storage unit 130, adds the stereophonically-processed sound effect signal 134 to the normal acoustic signal 131, and outputs the resulting signal.

The speakers 150L and 150R are an example of a sound output unit that outputs the acoustic signal output from the acoustic processing unit 120. The speakers 150L and 150R each reproduce the acoustic signal (the acoustic signal obtained by synthesizing the normal acoustic signal 131 and the sound effect signal 132) output from the acoustic signal output unit 140. The game apparatus 100 according to this embodiment includes at least two speakers. The game apparatus 100 may include three or more speakers.

Figure 21:
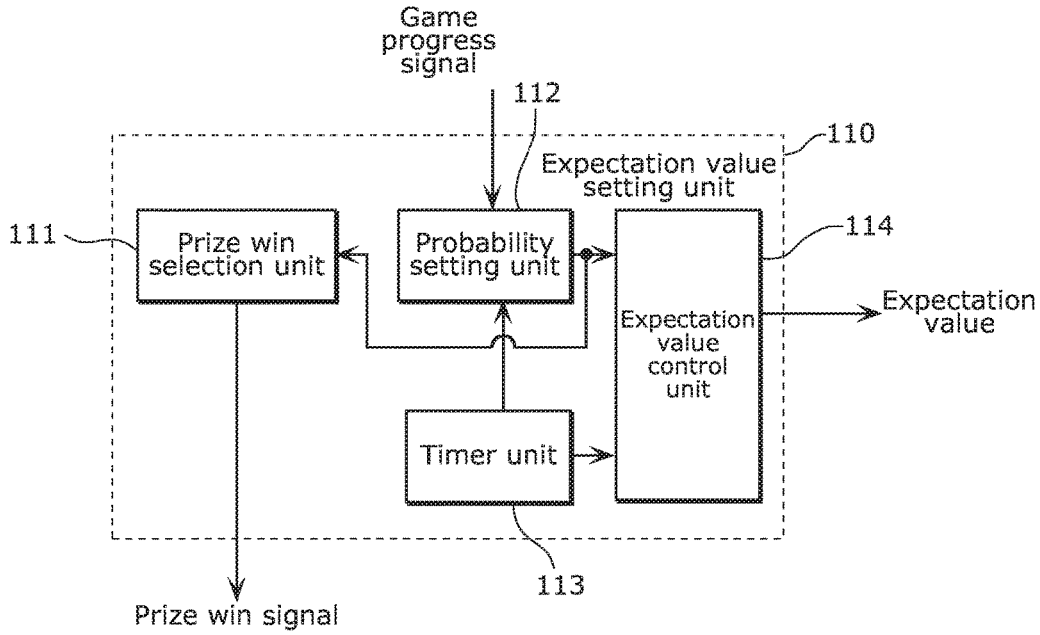
FIG. 21 is a block diagram illustrating an example of the structure of an expectation value setting unit according to Embodiment 5.

The detailed structure of the expectation value setting unit 110 is described below, with reference to FIG. 21. FIG. 21 is a block diagram illustrating an example of the structure of the expectation value setting unit 110 according to Embodiment 5.

The expectation value setting unit 110 includes a prize win selection unit 111, a probability setting unit 112, a timer unit 113, and an expectation value control unit 114, as illustrated in FIG. 21.

The prize win selection unit 111 determines the win or loss of the game, i.e. prize win or non-prize win, based on a predetermined probability. In detail, the prize win selection unit 111 selects prize win or non-prize win depending on the probability set by the probability setting unit 112. In the case of prize win, the prize win selection unit 111 outputs a prize win signal.

The probability setting unit 112 sets the probability of winning the game. In detail, the probability setting unit 112 sets the probability of prize win or non-prize win for the game. For example, the probability setting unit 112 determines the probability of prize win or non-prize win, based on duration information from the timer unit 113, the progress of the game in the whole game apparatus 100, and the like. The probability setting unit 112 changes the probability of prize win or non-prize win, for example, depending on the game skill of the player, an accidental change in state of the game, and the like. The probability setting unit 112 outputs a signal indicating the set probability to the prize win selection unit 111 and the expectation value control unit 114.

The timer unit 113 measures the duration of the game. For example, the timer unit 113 measures the time elapsed from the start of the game by the player. The timer unit 113 outputs a signal indicating the measured duration to the probability setting unit 112 and the expectation value control unit 114.

The expectation value control unit 114 sets the expectation value of the player winning the game, based on the probability set by the probability setting unit 112 and the duration measured by the timer unit 113. In detail, the expectation value control unit 114 receives the signal output from the probability setting unit 112 and the signal output from the timer unit 113, and controls the expectation value of the player winning the game which represents the expectation provided to the player.

For example, the expectation value control unit 114 increases the expectation value in the case where the duration measured by the timer unit 113 reaches a predetermined time length. For example, the expectation value control unit 114 sets a higher expectation value in the case where the duration is long than in the case where the duration is short. Thus, the expectation value control unit 114 may set the expectation value so as to be positively correlated with the duration.

The expectation value control unit 114 varies the expectation value depending on the prize win probability set by the probability setting unit 112. For example, the expectation value control unit 114 sets a higher expectation value in the case where the prize win probability is high than in the case where the prize win probability is low. Thus, the expectation value control unit 114 may set the expectation value so as to be positively correlated with the prize win probability.

As described above, the prize win selection unit 111 and the expectation value control unit 114 respectively perform prize win or non-prize win selection and expectation value setting, based on the probability set by the probability setting unit 112. This synchronizes the prize win or non-prize win probability and the expectation value, thus synchronizing the sense of expectation of win the player feels from the acoustic signal and the possibility of actually winning the game.

The operation of the expectation value setting unit 110 described above is merely illustrative, and any method may be used as long as the possibility of actually winning the game and the expectation of win presented to the player are synchronized.

Figure 22:
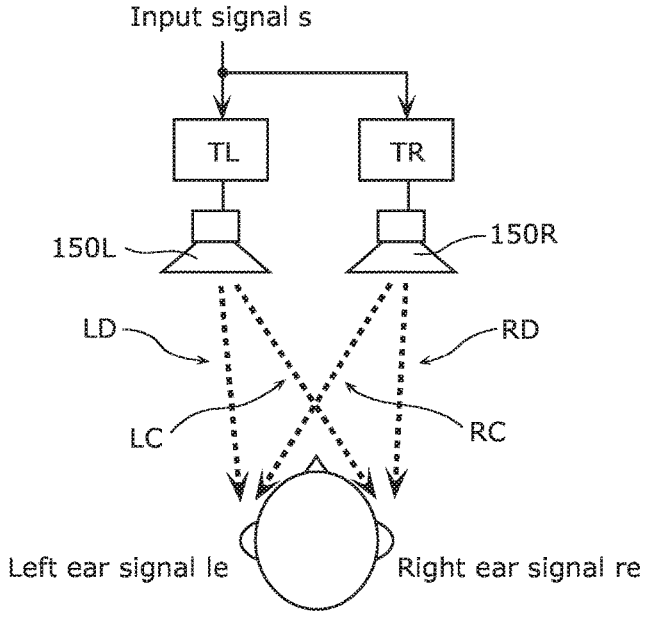
FIG. 22 is a diagram illustrating an example of signal flow until an acoustic signal reaches a player's ear according to Embodiment 5.

The following describes the method of generating the stereophonically-processed sound effect signal 134, with reference to FIG. 22. FIG. 22 is a diagram illustrating an example of signal flow until an acoustic signal reaches the player's ear(s) according to Embodiment 5. In detail, FIG. 22 illustrates signal flow when an input signal s is stereophonically processed and the processed signal is output from the speakers and reaches the left and right ears of the player.

The input signal s is processed by a stereophonic filter TL or TR, and output from the left speaker 150L or the right speaker 150R. The input signal s is the source acoustic signal of the non-stereophonically-processed sound effect signal 133 and the stereophonically-processed sound effect signal 134. Applying the process by the stereophonic filter TL or TR on the input signal s with predetermined strength yields the non-stereophonically-processed sound effect signal 133 and the stereophonically-processed sound effect signal 134.

The sound wave output from the left speaker 150L is subjected to the action of a spatial transfer function LD, and reaches the left ear of the player. The sound wave output from the left speaker 150L is subjected to the action of a spatial transfer function LC, and reaches the right ear of the player.

Likewise, the sound wave output from the right speaker 150R is subjected to the action of a spatial transfer function RD, and reaches the right ear of the player. The sound wave output from the right speaker 150R is subjected to the action of a spatial transfer function RC, and reaches the left ear of the player.

Thus, the left ear signal le reaching the left ear and the right ear signal re reaching the right ear satisfy Formula 3. In other words, the ear signal is obtained by multiplying the input signal s by the spatial acoustic transfer functions and the stereophonic transfer functions [TL, TR]. Here, [TL, TR] represents a matrix of two rows and one column (the same applies hereafter).

[Math. 5]

$$\begin{pmatrix} le \\ re \end{pmatrix} = \begin{pmatrix} LD & RC \\ LC & RD \end{pmatrix} \times \begin{pmatrix} TL \\ TR \end{pmatrix} \times (s). \quad \text{(Formula 3)}$$

The signal reaching the opposite ear to the speaker due to the action of the spatial transfer function LC or RC is a crosstalk signal.

An example of the method of designing a filter with strong crosstalk cancellation performance is described below. Strong crosstalk cancellation causes the input signal s to reach one ear and not to reach the opposite ear in FIG. 22. Accordingly, the target characteristics of the ear signal are set so that the left ear signal le is the input signal s and the right ear signal re is 0 as in Formula 4.

[Math. 6]

$$\begin{pmatrix} s \\ 0 \end{pmatrix} = \begin{pmatrix} LD & RC \\ LC & RD \end{pmatrix} \times \begin{pmatrix} TL \\ TR \end{pmatrix} \times (s). \quad \text{(Formula 4)}$$

Rearranging Formula 4 to Formula 5 yields the stereophonic transfer functions [TL, TR] to be the result of multiplying the inverse matrix of the determinant of the spatial acoustic transfer functions by the constant sequence [1, 0] as in Formula 6.

[Math. 7]

$$\begin{pmatrix} 1 \\ 0 \end{pmatrix} = \begin{pmatrix} LD & RC \\ LC & RD \end{pmatrix} \times \begin{pmatrix} TL \\ TR \end{pmatrix}. \quad \text{(Formula 5)}$$

[Math. 8]

$$\begin{pmatrix} TL \\ TR \end{pmatrix} = \begin{pmatrix} LD & RC \\ LC & RD \end{pmatrix}^{-1} \times \begin{pmatrix} 1 \\ 0 \end{pmatrix}. \quad \text{(Formula 6)}$$

The stereophonically-processed sound effect signal 134 is generated, for example, by performing a filter process having the stereophonic transfer functions [TL, TR] shown in Formula 6 on the input signal s.

Thus, the strength of crosstalk cancellation performance is greater when the ratio in intensity of the signals reaching both ears in the target characteristics of the ear signal is higher. This coincides with an actual physical phenomenon that whispering voice in one ear does not reach the opposite ear.

Hence, by increasing the strength of crosstalk cancellation performance when the expectation value set by the expectation value setting unit 110 is higher, the sense of expectation of winning the game can be produced with sound having a stronger sense of reproduction in the ear when the expectation value is higher. Although the above describes an example where the signal reaches the left ear and does not reach the right ear, the signal may reach the right ear instead of the left ear.

An example of the method of designing a filter with weak crosstalk cancellation performance is described below. The stereophonic transfer function TL is set to 1 and the stereophonic transfer function TR is set to 0, i.e. the signal is output only from one speaker. This forms a filter with weak crosstalk cancellation performance. In this case, the left ear signal le is s×LD and the right ear signal re is s×LC as in Formula 7, where the signal intensity is not significantly different between the left and right ears.

[Math. 9]

$$\begin{pmatrix} le \\ re \end{pmatrix} = \begin{pmatrix} LD & RC \\ LC & RD \end{pmatrix} \times \begin{pmatrix} 1 \\ 0 \end{pmatrix} \times (s) = \begin{pmatrix} s \times LD \\ s \times LC \end{pmatrix}. \quad \text{(Formula 7)}$$

Accordingly, the non-stereophonically-processed sound effect signal 133 may be, for example, the signal resulting from the filter process with the stereophonic transfer function TL set to 1 and the stereophonic transfer function TR set to 0.

The filter with strong crosstalk cancellation performance shown in Formula 6 is merely illustrative, and the stereophonically-processed sound effect signal 134 may be generated by another filter.

Figure 23:
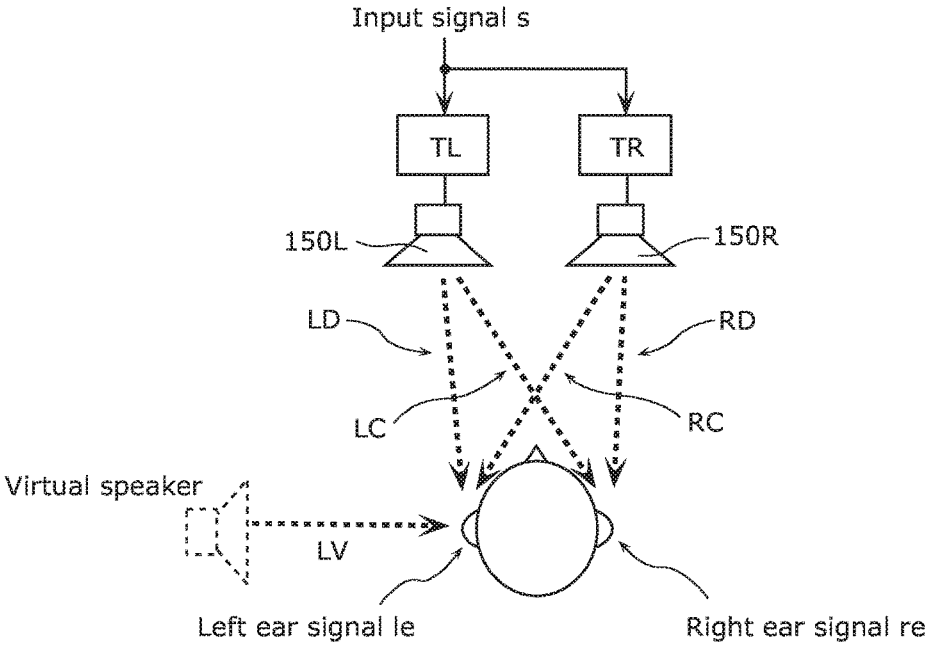
FIG. 23 is a diagram illustrating another example of signal flow until an acoustic signal reaches a player's ear according to Embodiment 5.

FIG. 23 is a diagram illustrating another example of signal flow until an acoustic signal reaches the player's ear(s) according to Embodiment 5. FIG. 23 differs from FIG. 22 in that a virtual speaker is set.

The virtual speaker is an example of a virtual sound source placed on the side of the player. In detail, the virtual speaker outputs sound from the direction approximately perpendicular to the direction in which the player faces, toward the player's ear. A spatial transfer function LV is the transfer function of sound from the speaker to the ear if the actual speaker is placed at the position of the virtual speaker.

Formula 8 represents the target characteristics of the ear signal reaching the player's ear in the signal flow illustrated in FIG. 23. In detail, Formula 8 indicates such target characteristics according to which the signal obtained by multiplying the input signal s by the spatial transfer function LV, i.e. such a signal that makes the input signal appear to come from the direction of approximately 90 degrees of the player, reaches the left ear, and no signal reaches the right ear, i.e. the signal is 0.

[Math. 10]

$$\begin{pmatrix} s \times LV \\ 0 \end{pmatrix} = \begin{pmatrix} LD & RC \\ LC & RD \end{pmatrix} \times \begin{pmatrix} TL \\ TR \end{pmatrix} \times (s). \quad \text{(Formula 8)}$$

Rearranging Formula 8 yields the stereophonic transfer functions [TL, TR] to be the result of multiplying the inverse matrix of the determinant of the spatial acoustic transfer functions by the constant sequence [LV, 0], as in Formula 9.

[Math. 11]

$$\begin{pmatrix} TL \\ TR \end{pmatrix} = \begin{pmatrix} LD & RC \\ LC & RD \end{pmatrix}^{-1} \times \begin{pmatrix} LV \\ 0 \end{pmatrix}. \quad \text{(Formula 9)}$$

The stereophonically-processed sound effect signal 134 may be generated, for example, by performing a filter process having the stereophonic transfer functions [TL, TR] shown in Formula 9 on the input signal s.

Although the virtual speaker is set at the position of approximately 90 degrees of the player in the example illustrated in FIG. 23, the virtual speaker does not necessarily need to be at approximately 90 degrees as long as it is on the side of the player. Although the signal reaches the left ear and does not reach the right ear in the above example, the signal may reach the right ear instead of the left ear.

As described above, the game apparatus 100 according to this embodiment includes: the expectation value setting unit 110 that sets an expectation value of a player winning a game; the acoustic processing unit 120 that outputs an acoustic signal corresponding to the expectation value set by the expectation value setting unit 110; and at least two speakers 150L and 150R that output the acoustic signal output from the acoustic processing unit 120, wherein the acoustic processing unit 120, in the case where the expectation value set by the expectation value setting unit 110 is greater than a predetermined threshold, outputs the acoustic signal processed by a filter with stronger crosstalk cancellation performance than in the case where the expectation value is less than the threshold.

With this structure, in the case where the expectation value is high, the acoustic signal processed by the filter with stronger crosstalk cancellation performance than in the case where the expectation value is low is output, so that the player can feel a higher sense of expectation of winning the game from the sound heard in his or her ear(s). For example, the sense of expectation of the player winning the game can be produced by a whisper or sound effect heard in the player's ear(s). The sense of expectation of the player winning the game can be heightened in this way.

Moreover, in the game apparatus 100 according to this embodiment, the acoustic processing unit 120 includes: the acoustic signal storage unit 130 that stores the stereophonically-processed sound effect signal 134 processed by the filter with stronger crosstalk cancellation performance, and the non-stereophonically-processed sound effect signal 133 processed by a filter with weaker crosstalk cancellation performance than the stereophonically-processed sound effect signal 134; and the acoustic signal output unit 140 that selects and outputs the stereophonically-processed sound effect signal 134 in the case where the expectation value set by the expectation value setting unit 110 is greater than the threshold, and selects and outputs the non-stereophonically-processed sound effect signal 133 in the case where the expectation value set by the expectation value setting unit 110 is less than the threshold.

With this structure, one of the non-stereophonically-processed sound effect signal 133 and the stereophonically-processed sound effect signal 134 is selected based on the result of comparison between the expectation value and the threshold. The sense of expectation of the player winning the game can thus be heightened by a simple process. The non-stereophonically-processed sound effect signal 133 and the stereophonically-processed sound effect signal 134 may be generated and stored beforehand.

Moreover, in the game apparatus 100 according to this embodiment, the expectation value setting unit 110 includes: a probability setting unit 112 that sets a probability of winning the game; a timer unit 113 that measures duration of the game; and an expectation value control unit 114 that sets the expectation value, based on the probability set by the probability setting unit 112 and the duration measured by the timer unit 113.

With this structure, the expectation value is set based on the probability of winning the game and the duration. For example, the intension of the game apparatus 100 to let the player win the game and the sense of expectation of the player winning the game can be synchronized.

Although this embodiment describes the case where the acoustic processing unit 120 prepares the non-stereophonically-processed sound effect signal 133 and the stereophonically-processed sound effect signal 134 beforehand and selects one of the signals depending on the expectation value, this is not a limitation. For example, instead of preparing two signals beforehand, the sound effect signal may be changed by switching stereophonic software that runs in real time. In detail, the acoustic processing unit 120 may execute the stereophonic process on the sound effect signal and output the result in the case where the expectation value is greater than the threshold, and output the sound effect signal without executing the stereophonic process in the case where the expectation value is less than the threshold.

Although this embodiment describes the case where the acoustic signal storage unit 130 stores two types of signals, namely, the non-stereophonically-processed sound effect signal 133 and the stereophonically-processed sound effect signal 134, beforehand, this is not a limitation. For example, the acoustic signal storage unit 130 may store a plurality of signals that differ in the degree of stereophonic effect. In this case, the acoustic signal output unit 140 may switch between the plurality of signals depending on the expectation value set by the expectation value setting unit 110.

For example, the acoustic signal storage unit 130 stores three sound effect signals including a first sound effect signal, a second sound effect signal, and a third sound effect signal. Of the three sound effect signals, the first sound effect signal has the weakest stereophonic effect, and the third sound effect signal has the strongest stereophonic effect.

The acoustic signal output unit 140 reads and outputs the first sound effect signal, in the case where the expectation value is less than a first threshold. The acoustic signal output unit 140 reads and outputs the second sound effect signal, in the case where the expectation value is greater than the first threshold and less than a second threshold. The acoustic signal output unit 140 reads and outputs the third sound effect signal, in the case where the expectation value is greater than the second threshold. The first threshold is less than the second threshold.

The sound effect signal that differs in stereophonic effect is thus output depending on the expectation value. The sound effect signal corresponding to the sense of expectation of the player can be output in this way.

Although this embodiment describes the case where the sense of expectation of win of the player is produced in the relationship between the game apparatus 100 and the player, this is not a limitation. For example, among a plurality of players through the game apparatus 100, the sense of expectation may be produced by an acoustic signal for a player with increased expectation of win.

Although this embodiment omits the description of the sound volume when adding the sound effect (sporadically output sound) to the normal acoustic signal 131 (e.g. constantly output background music, etc.) for simplicity's sake, the sound volume of the normal acoustic signal or sound effect signal may be changed based on the expectation value.

Figure 24:
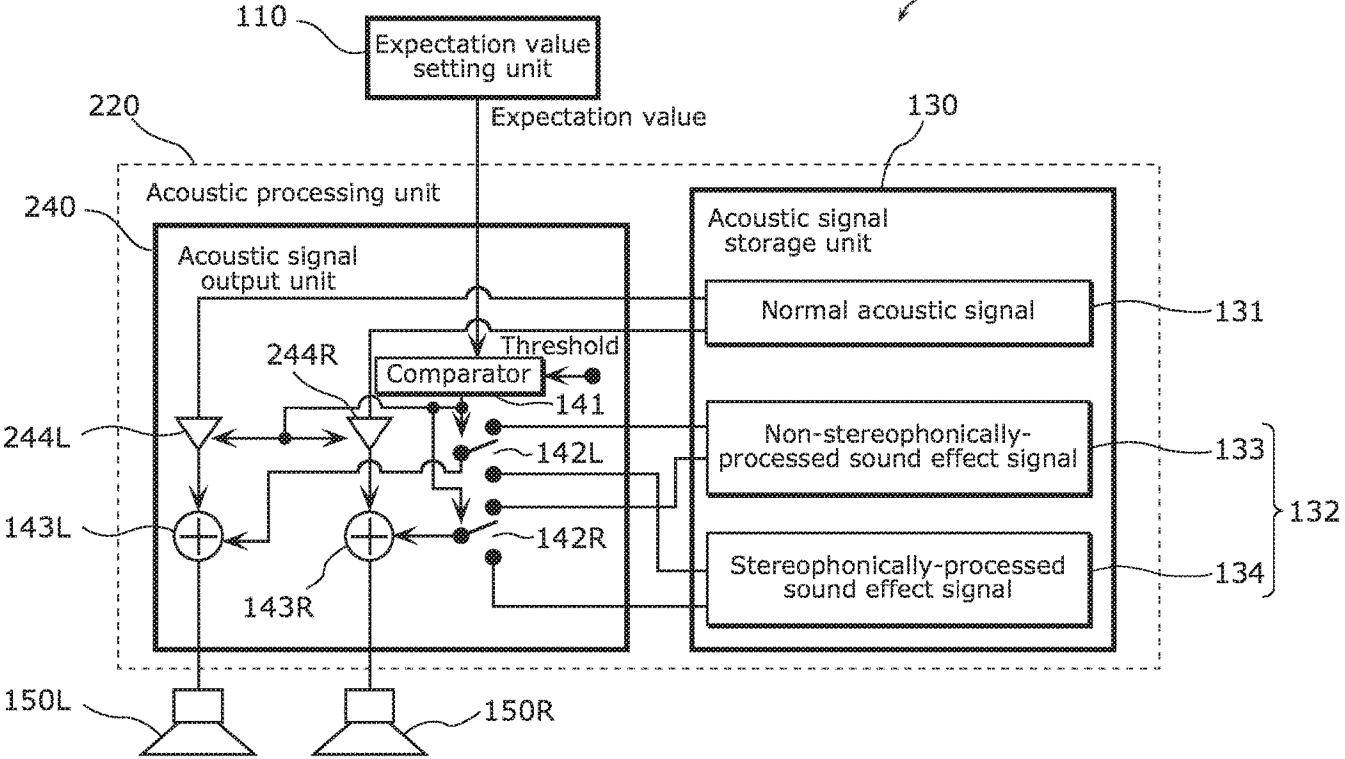
FIG. 24 is a block diagram illustrating another example of the structure of the game apparatus according to Embodiment 5.

FIG. 24 is a block diagram illustrating another example of the structure of the game apparatus according to Embodiment 5. In detail, FIG. 24 illustrates an example of the structure of a game apparatus 200 capable of controlling the sound volume in the case of adding the sound effect.

The game apparatus 200 illustrated in FIG. 24 differs from the game apparatus 100 illustrated in FIG. 19 in that an acoustic processing unit 220 is included instead of the acoustic processing unit 120. The acoustic processing unit 220 differs from the acoustic processing unit 120 in that an acoustic signal output unit 240 is included instead of the acoustic signal output unit 140. The acoustic signal output unit 240 differs from the acoustic signal output unit 140 in that sound volume adjustment units 244L and 244R are further included.

The sound volume adjustment units 244L and 244R each receive the comparison result from the comparator 141, and adjusts the sound volume of the normal acoustic signal 131. In detail, the sound volume adjustment units 244L and 244R each decrease the sound volume of the normal acoustic signal 131 in the case of selecting the stereophonically-processed sound effect signal 134 than in the case of selecting the non-stereophonically-processed sound effect signal 133. This enhances the stereophonic effect (in particular, the effect of localizing the sound image to the ear), and provides the effect to the player.

Here, the sound volume of the sound effect signal 132 may be adjusted instead of the sound volume of the normal acoustic signal 131. In detail, in the case of selecting the stereophonically-processed sound effect signal 134, the sound volume adjustment unit may increase the sound volume of the stereophonically-processed sound effect signal 134 than in the case of selecting the non-stereophonically-processed sound effect signal 133.

Although this embodiment describes an example where the stereophonic process achieves the acoustic effects at the player's ear(s), this is not a limitation. For example, the stereophonic process may achieve the surroundness of sound in the space around the player.

Figure 25:
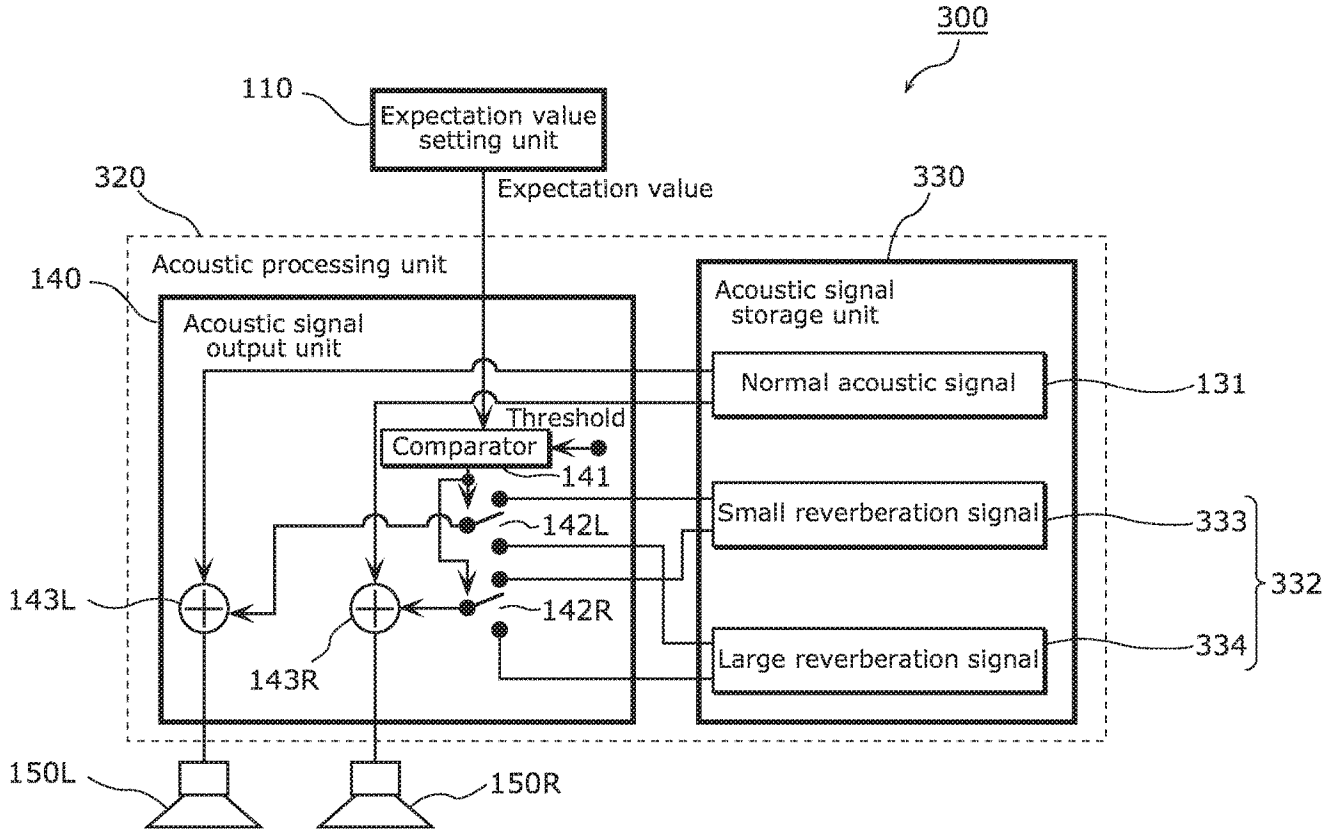
FIG. 25 is a block diagram illustrating another example of the structure of the game apparatus according to Embodiment 5.

FIG. 25 is a block diagram illustrating another example of the structure of the game apparatus according to Embodiment 5. In detail, FIG. 25 illustrates an example of the structure of a game apparatus 300 capable of selectively outputting an artificially added reverberation signal based on the expectation value.

The game apparatus 300 illustrated in FIG. 25 differs from the game apparatus 100 illustrated in FIG. 19 in that an acoustic processing unit 320 is included instead of the acoustic processing unit 120. The acoustic processing unit 320 adds a larger reverberation component to the acoustic signal and outputs the resulting acoustic signal in the case where the expectation value set by the expectation value setting unit 110 is greater than the threshold than in the case where the expectation value is less than the threshold.

In detail, the acoustic processing unit 320 differs from the acoustic processing unit 120 in that an acoustic signal storage unit 330 is included instead of the acoustic signal storage unit 130. The acoustic signal storage unit 330 differs from the acoustic signal storage unit 130 in that a reverberation signal 332 is stored instead of the sound effect signal 132.

The reverberation signal 332 is a signal indicating an artificially generated reverberation component. The reverberation signal 332 includes a small reverberation signal 333 and a large reverberation signal 334. The small reverberation signal 333 has a smaller reverberation signal level and reverberation length than the large reverberation signal 334.

For example, the selectors 142L and 142R each receive the comparison result from the comparator 141, and select one of the small reverberation signal 333 and the large reverberation signal 334. In detail, the selectors 142L and 142R each select the large reverberation signal 334 in the case where the expectation value is greater than the threshold, and select the small reverberation signal 333 in the case where the expectation value is less than the threshold.

In the case where the expectation value set by the expectation value setting unit 110 is high, the level and reverberation length of the artificially added reverberation signal can be increased than in the case where expectation value is low. This produces the player's sense of expectation for the game by the surroundness of sound in the space around the player.

Although the acoustic signal storage unit 330 stores two types of reverberation signals in the example in FIG. 25, the acoustic signal storage unit 330 may store only one type of reverberation signal. In this case, the selectors 142L and 142R each select the reverberation signal in the case where the expectation value is greater than the threshold, and do not select the reverberation signal in the case where the expectation value is less than the threshold.

Thus, the game apparatus 300 according to a modification to Embodiment 5 includes: the expectation value setting unit 110 that sets an expectation value of a player winning a game; the acoustic processing unit 320 that outputs an acoustic signal corresponding to the expectation value set by the expectation value setting unit 110; and at least two speakers 150L and 150R that output the acoustic signal output from the acoustic processing unit 320, wherein the acoustic processing unit 320, in the case where the expectation value set by the expectation value setting unit 110 is greater than a predetermined threshold, adds a larger reverberation component to the normal acoustic signal 131 than in the case where the expectation value is less than the threshold, and outputs the resulting normal acoustic signal 131.

With this structure, in the case where the expectation value is high, a larger reverberation component is added to the acoustic signal than in the case where the expectation value is low. By doing so, the player's sense of expectation for the game can be produced by the surroundness of sound in the space around the player.

Embodiment 6

A game apparatus according to Embodiment 6 is described below, with reference to drawings.

Figure 26:
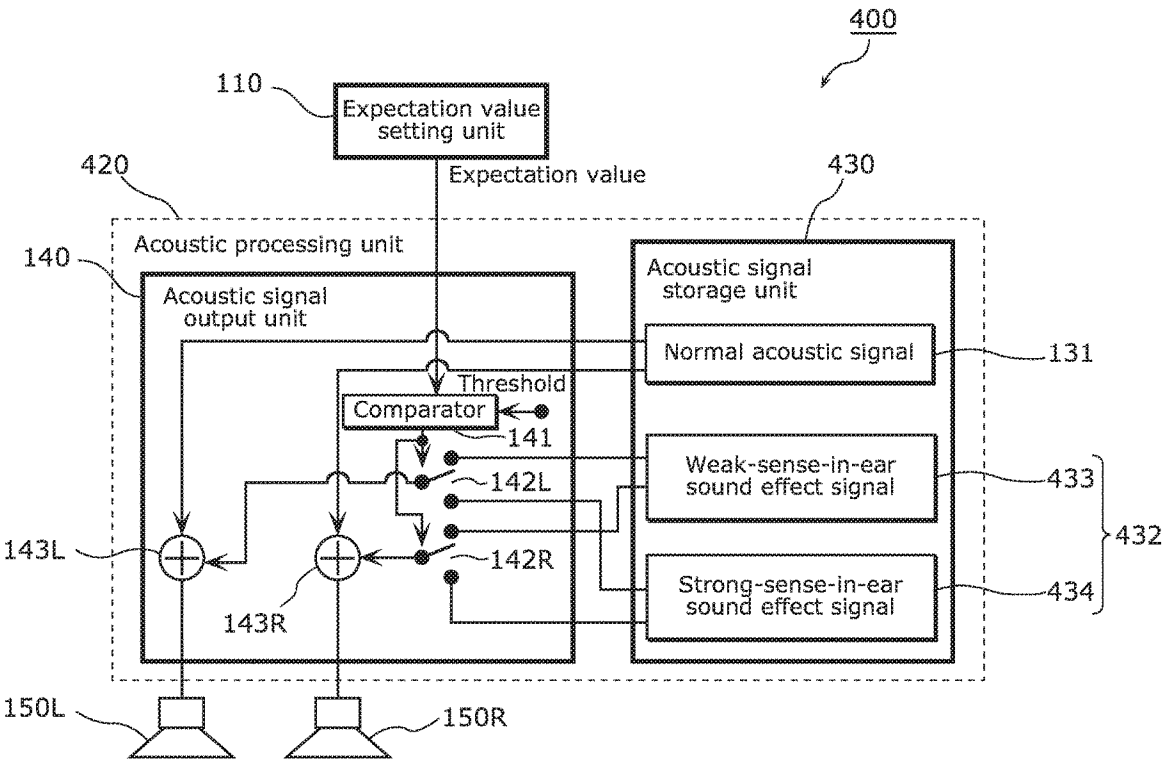
FIG. 26 is a block diagram illustrating an example of the structure of a game apparatus according to Embodiment 6.

FIG. 26 is a block diagram illustrating the structure of a game apparatus 400 according to Embodiment 6. The game apparatus 400 according to Embodiment 6 produces a sense of expectation of a player winning a game by the technology of adjusting the strength of the sense of reproduction in the ear(s). For example, the game apparatus 400 is a pachinko machine or the like as illustrated in FIG. 20, as in Embodiment 5.

The game apparatus 400 illustrated in FIG. 26 differs from the game apparatus 100 illustrated in FIG. 19 according to Embodiment 5 in that an acoustic processing unit 420 is included instead of the acoustic processing unit 120. The acoustic processing unit 420 outputs a sound effect signal with a stronger sense of reproduction in the ear, in the case where expectation value set by the expectation value setting unit 110 is greater than the threshold.

In detail, the acoustic processing unit 420 differs from the acoustic processing unit 120 in that an acoustic signal storage unit 430 is included instead of the acoustic signal storage unit 130. The acoustic signal storage unit 430 differs from the acoustic signal storage unit 130 in that a sound effect signal 432 is stored instead of the sound effect signal 132.

The sound effect signal 432 is an acoustic signal sporadically provided depending on the state of the game. The sound effect signal 432 includes a weak-sense-in-ear sound effect signal 433 and a strong-sense-in-ear sound effect signal 434.

The weak-sense-in-ear sound effect signal 433 is an example of a second acoustic signal generated by signal processing with weak crosstalk cancellation performance. For example, the weak-sense-in-ear sound effect signal 433 is such an acoustic signal that is heard with approximately the same loudness in both ears of the player. The strong-sense-in-ear sound effect signal 434 is an example of a first acoustic signal generated by signal processing with strong crosstalk cancellation performance. For example, the strong-sense-in-ear sound effect signal 434 is such an acoustic signal that is heard in one ear of the player but hardly heard in the other ear of the player.

For example, the selectors 142L and 142R each receive the comparison result from the comparator 141, and select one of the weak-sense-in-ear sound effect signal 433 and the strong-sense-in-ear sound effect signal 434. In detail, the selectors 142L and 142R each select the strong-sense-in-ear sound effect signal 434 in the case where the expectation value is greater than the threshold, and select the weak-sense-in-ear sound effect signal 433 in the case where the expectation value is less than the threshold.

In the case where the expectation value set by the expectation value setting unit 110 is high, the strong-sense-in-ear sound effect signal 434 can be output than in the case where expectation value is low. This produces the player's sense of expectation for the game by the surroundness of sound in the space around the player.

The following describes a filter process for generating signals that differ in the sense of reproduction in the ear(s), with reference to FIG. 16. The transfer functions LVD and LVC, the parameters $\alpha$ and $\beta$, etc. are the same as those described in Embodiment 4.

The parameters $\alpha$ and $\beta$ in Formulas 1 and 2 are determined based on the expectation value of the player winning the game which is set by the expectation value setting unit 110. In detail, $\alpha$ and $\beta$ are set so that the difference between $\alpha$ and $\beta$ is greater when the expectation value is higher. For example, the enjoyment of the exciting game can be increased by setting $\alpha$ and $\beta$ to have a large difference ($\alpha >> \beta$) when the expectation value is high and setting $\alpha$ and $\beta$ to be nearly equal ($\alpha \approx \beta$) when the expectation value is not so high.

By determining $\alpha$ and $\beta$ depending on the expectation value in this way, the weak-sense-in-ear sound effect signal 433 and the strong-sense-in-ear sound effect signal 434 are generated. In detail, the weak-sense-in-ear sound effect signal 433 is generated in the case where $\alpha \approx \beta$, and the strong-sense-in-ear sound effect signal 434 is generated in the case where $\alpha >> \beta$.

As described above, in the game apparatus 400 according to this embodiment, the acoustic processing unit 420 determines, in a filter process using: a first transfer function of sound from a virtual speaker placed on a side of the player to a first ear of the player nearer the virtual speaker; a second transfer function of sound from the virtual speaker to a second ear of the player opposite to the first ear; a first parameter by which the first transfer function is multiplied; and a second parameter by which the second transfer function is multiplied, the first parameter and the second parameter depending on the expectation value set by the expectation value setting unit 110, to output the acoustic signal processed by the filter with stronger crosstalk cancellation performance.

With this structure, the parameters are determined depending on the expectation value. Accordingly, for example, the degree of the sense of expectation of the player winning the game can be produced by the loudness of a whisper or sound effect heard in the player's ear(s).

Moreover, in the game apparatus 400 according to this embodiment, the acoustic processing unit 420, in the case where the expectation value set by the expectation value setting unit 110 is greater than the threshold, determines the first parameter and the second parameter that differ from each other more than in the case where the expectation value is less than the threshold.

With this structure, when the expectation value is higher, the sound heard in one ear increases and the sound heard in the other ear decreases. Accordingly, for example, the degree of the sense of expectation of the player winning the game can be produced by a whisper or sound effect heard in the player's ear(s).

Although the virtual speaker is set at the position of approximately 90 degrees of the player in the example illustrated in FIG. 16, the virtual speaker does not necessarily need to be at approximately 90 degrees as long as it is on the side of the player. Although the above describes the process relating to the left ear, the process may relate to the right ear. Alternatively, the process relating to the left ear and the process relating to the right ear may be simultaneously performed to produce the sense of reproduction in both ears.

Modification to Embodiment 6

Although Embodiment 6 describes the case where the acoustic processing unit 420 prepares the weak-sense-in-ear sound effect signal 433 and the strong-sense-in-ear sound effect signal 434 through the process for the sense of reproduction in the ear(s) beforehand and selects one of the signals depending on the expectation value, this is not a limitation. For example, instead of preparing two signals beforehand, the stereophonic transfer functions [TL, TR] are adjusted depending on the expectation value to perform filtering in real time.

Figure 27:
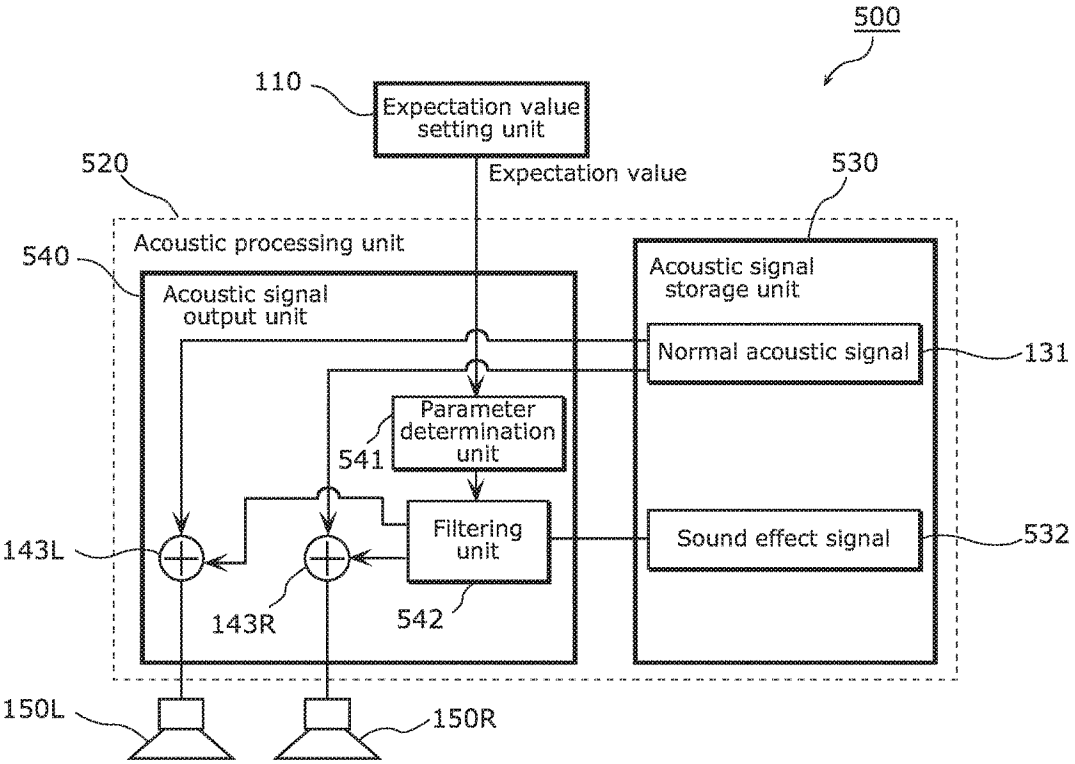
FIG. 27 is a block diagram illustrating an example of the structure of a game apparatus according to a modification to Embodiment 6.

For example, a game apparatus 500 according to a modification to Embodiment 6 illustrated in FIG. 27 performs, on the sound effect signal, the filter process using the parameters determined depending on the expectation value in real time. FIG. 27 is a block diagram illustrating the structure of the game apparatus 500 according to a modification to Embodiment 6.

As illustrated in FIG. 27, the game apparatus 500 differs from the game apparatus 100 illustrated in FIG. 19 in that an acoustic processing unit 520 is included instead of the acoustic processing unit 120.

The acoustic processing unit 520 outputs the acoustic signal corresponding to the expectation value set by the expectation value setting unit 110. For example, the acoustic processing unit 520 determines, in the filter process using the transfer functions LVD and LVC and the parameters $\alpha$ and $\beta$, the parameters $\alpha$ and $\beta$ depending on the expectation value set by the expectation value setting unit 110. The acoustic signal processed by the filter with stronger crosstalk cancellation performance is thus generated and output.

The acoustic processing unit 520 includes an acoustic signal storage unit 530 and an acoustic signal output unit 540, as illustrated in FIG. 27.

The acoustic signal storage unit 530 is memory for storing acoustic signals. The acoustic signal storage unit 530 stores the normal acoustic signal 131 and a sound effect signal 532. The normal acoustic signal 131 is the same as that in Embodiment 5. The sound effect signal 532 is an acoustic signal sporadically provided depending on the state of the game.

The acoustic signal output unit 540 generates and outputs a sound effect signal with a weak sense of reproduction in the ear(s) and a sound effect signal with a strong sense of reproduction in the ear(s), depending on the expectation value set by the expectation value setting unit 101. The acoustic signal output unit 540 includes a parameter determination unit 541 and a filtering unit 542.

The parameter determination unit 541 determines the parameters $\alpha$ and $\beta$ based on the expectation value set by the expectation value setting unit 110. In detail, the parameter determination unit 541 determines the parameters $\alpha$ and $\beta$ so that the difference between $\alpha$ and $\beta$ is greater in the case where the expectation value set by the expectation value setting unit 110 is greater than the threshold than in the case where the expectation value is less than the threshold. For example, the parameter determination unit 541 determines the parameters $\alpha$ and $\beta$ to have a larger difference when the expectation value is higher.

For example, the parameter determination unit 541 determines $\alpha$ and $\beta$ described with reference to FIG. 16, in coordination with the expectation value of the player winning the game which is set by the expectation value setting unit 110. In detail, the parameter determination unit 541 determines $\alpha$ and $\beta$ so that the difference between $\alpha$ and $\beta$ is greater when the expectation value is higher. For example, the enjoyment of the exciting game can be increased by the parameter determination unit 541 setting $\alpha$ and $\beta$ to have a large difference ($\alpha >> \beta$) when the expectation value is high and setting $\alpha$ and $\beta$ to be nearly equal ($\alpha \approx \beta$) when the expectation value is not so high.

The filtering unit 542 performs the filter process using the transfer functions LVD and LVC and the parameters $\alpha$ and $\beta$, on the sound effect signal. In other words, the filtering unit 542 executes the filter process for adjusting the sense of reproduction in the ear(s), on the sound effect signal. For example, the filtering unit 542 processes the sound effect signal 532 using the stereophonic transfer functions [TL, TR] in Formula 2.

The game apparatus 500 according to a modification to Embodiment 6 thus determines the parameters depending on the expectation value. Accordingly, for example, the degree of the sense of expectation of the player winning the game can be produced by the loudness of a whisper or sound effect heard in the player's ear(s).

As described above, in the game apparatus 500 according to a modification to this embodiment, the acoustic processing unit 520 determines, in a filter process using: a first transfer function of sound from a virtual speaker placed on a side of the player to a first ear of the player nearer the virtual speaker; a second transfer function of sound from the virtual speaker to a second ear of the player opposite to the first ear; a first parameter by which the first transfer function is multiplied; and a second parameter by which the second transfer function is multiplied, the first parameter and the second parameter depending on the expectation value set by the expectation value setting unit 110, to output the acoustic signal processed by the filter with stronger crosstalk cancellation performance.

With this structure, the parameters are determined depending on the expectation value. Accordingly, for example, the degree of the sense of expectation of the player winning the game can be produced by a whisper or sound effect heard in the player's ear(s).

Moreover, in the game apparatus 500 according to this embodiment, the acoustic processing unit 520, in the case where the expectation value set by the expectation value setting unit 110 is greater than the threshold, determines the first parameter and the second parameter that differ from each other more than in the case where the expectation value is less than the threshold.

With this structure, when the expectation value is higher, the sound heard in one ear increases and the sound heard in the other ear decreases. Accordingly, for example, the degree of the sense of expectation of the player winning the game can be produced by a whisper or sound effect heard in the player's ear(s).

Other Embodiments

Although Embodiments 1 to 6 have been described above to illustrate the disclosed technology, the disclosed technology is not limited to such. Changes, replacements, additions, omissions, etc. may be made to the embodiments as appropriate, and structural elements described in Embodiments 1 to 6 may be combined as a new embodiment.

Other embodiments are summarized below.

These general and specific embodiments of the audio reproduction apparatus and game apparatus described in the foregoing embodiments may be implemented using a system, a method, an integrated circuit, a computer program, or a computer-readable recording medium such as a CD-ROM, or any combination of systems, methods, integrated circuits, computer programs, or recording media.

The disclosed technology includes, for example, a signal processing apparatus in which the speaker array (speaker elements) is omitted from the audio reproduction apparatus described in each of the foregoing embodiments.

For example, the structural elements (the expectation value setting unit 110, the acoustic processing unit 120, the acoustic signal storage unit 130, and the acoustic signal output unit 140) in the game apparatus according to Embodiment 5 may be implemented by software such as a program executed on a computer including a central processing unit (CPU), random access memory (RAM), ROM, a communication interface, an I/O port, a hard disk, a display, etc., or implemented by hardware such as electronic circuitry. The same applies to the structural elements in each of the game apparatuses 200 to 500 according to the other embodiments.

The game apparatus according to the present disclosure provides a sense of expectation of a player winning a game using an acoustic signal, and so can increase the enjoyment of a game in a slot machine or the like. Such technology can be widely used in game apparatuses.

Each of the structural elements in each of the foregoing embodiments may be configured in the form of an exclusive hardware product, or may be realized by executing a software program suitable for the structural element. Each of the structural elements may be realized by means of a program executing unit, such as a CPU and a processor, reading and executing the software program recorded on a recording medium such as a hard disk or semiconductor memory.

The foregoing embodiments are described to illustrate the disclosed technology, through the detailed description with reference to the accompanying drawings.

The structural elements in the detailed description and the accompanying drawings may include not only the structural elements necessary for the solution but also the structural elements not necessary for the solution, to illustrate the disclosed technology. The inclusion of such optional structural elements in the detailed description and the accompanying drawings therefore does not mean that these optional structural elements are necessary structural elements.

The foregoing embodiments are intended to be illustrative of the disclosed technology, and so various changes, replacements, additions, omissions, etc. can be made within the scope of the appended Claims and their equivalents.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

The invention claimed is:

1. An audio reproduction apparatus that localizes sound to an ear of a listener, the audio reproduction apparatus comprising:

a signal processing unit configured to convert an audio signal into N channel signals, where N is an integer greater than or equal to 3; and a speaker array including at least N speaker elements linearly arranged in an arrangement direction, that respectively output the N channel signals as reproduced sound, wherein:

the signal processing unit includes:

a beam formation unit configured to perform a beam formation process of resonating the reproduced sound output from the speaker array at a position of one ear of the listener; and a crosstalk canceller which, as a cancellation process, allows for spatial audio reproduction which comprises portions of rendered audio reaching one ear while the portion of rendered audio does not reach the other ear, in order to create sense of depth, panning or object based audio inherent to spatial audio reproduction, the N channel signals are obtained by performing the beam formation process and the cancellation process on the audio signal, N is an even number, the crosstalk canceller is configured to perform a crosstalk cancellation process which is the cancellation process on each of N/2 pairs of N signals generated by performing the beam formation process on the audio signal, to generate the N channel signals, the N/2 pairs are channels positioned symmetrically with respect to the center of the at least N linearly arranged speaker elements in the arrangement direction, and all of the speaker elements included in the speaker array face the listener.

2. The audio reproduction apparatus according to claim 1, wherein the beam formation unit includes:

a band division filter that generates band signals by dividing the audio signal into predetermined frequency bands;

a distribution unit configured to distribute the generated band signals to each of channels corresponding to the N speaker elements;

a position/band-specific filter that performs a filter process on each of the distributed band signals depending on a position of a speaker element to which the band signal is distributed and a frequency band of the band signal, and output a resulting band signal as a filtered signal; and a band synthesis filter that band-synthesizes a plurality of filtered signals belonging to a same channel.

3. The audio reproduction apparatus according to claim 2, wherein the band division filter divides the audio signal into a high-frequency band signal and a low-frequency band signal, and the position/band-specific filter, in the case where the filter process is performed on H high-frequency band signals out of N distributed high-frequency band signals where H is a positive integer less than or equal to N, performs the filter process on L low-frequency band signals out of N distributed low-frequency band signals where L is a positive integer less than H.

4. The audio reproduction apparatus according to claim 2, wherein the position/band-specific filter performs the filter process on the distributed band signal, to cause an amplitude of a filtered signal of a specific channel to be greater than each of amplitudes of filtered signals of channels adjacent to the specific channel on both sides.

5. The audio reproduction apparatus according to claim 1, wherein the signal processing unit further includes a low-pitch enhancement unit configured to add a harmonic component of a low-frequency part of the audio signal before the cancellation process, to the audio signal.

6. An audio reproduction apparatus that localizes sound to an ear of a listener, the audio reproduction apparatus comprising:

a signal processing unit configured to convert an audio signal into a left channel signal and a right channel signal;

a left speaker element that outputs the left channel signal as reproduced sound; and a right speaker element that outputs the right channel signal as reproduced sound, wherein:

the signal processing unit is configured to perform a filter process using: a first transfer function of sound from a virtual sound source placed on a side of the listener to a first ear of the listener nearer the virtual sound source; a second transfer function of sound from the virtual sound source to a second ear of the listener opposite to the first ear; a first parameter by which the first transfer function is multiplied; and a second parameter by which the second transfer function is multiplied, in the case where the first parameter is α, the second parameter is β, and a ratio α/β of the first parameter and the second parameter is R, the signal processing unit is configured to:

set R to a first value equal to 1, when a distance between the virtual sound source and the listener is a first distance; and set R to a second value greater than the first value, when the distance between the virtual sound source and the listener is a second distance that is shorter than the first distance, and in the case where TL is a first stereophonic transfer function of sound for generating the left channel signal, TR is a second stereophonic transfer function of sound for generating the right channel signal, LD is a transfer function of sound from the left speaker to the first ear, LC is a transfer function of sound from the left speaker to the second ear, RC is a transfer function of sound from the right speaker to the first ear, and RD is a transfer function of sound from the right speaker to the second ear, TL and TR are calculated from a formula:

$$\begin{pmatrix} TL \\ TR \end{pmatrix} = \begin{pmatrix} LD & RC \\ LC & RD \end{pmatrix}^{-1} \times \begin{pmatrix} LVD \times \alpha \\ LVC \times \beta \end{pmatrix}.$$

7. An audio reproduction apparatus that localizes sound to an ear of a listener, the audio reproduction apparatus comprising:

a signal processing unit configured to convert an audio signal into a left channel signal and a right channel signal;

a left speaker element that outputs the left channel signal as reproduced sound; and a right speaker element that outputs the right channel signal as reproduced sound, wherein:

the signal processing unit is configured to perform a filter process using: a first transfer function of sound from a virtual sound source placed on a side of the listener to a first ear of the listener nearer the virtual sound source; a second transfer function of sound from the virtual sound source to a second ear of the listener opposite to the first ear; a first parameter by which the first transfer function is multiplied; and a second parameter by which the second transfer function is multiplied, in the case where the first parameter is α, the second parameter is β, and a ratio α/β of the first parameter and the second parameter is R, the signal processing unit is configured to:

set R to a value greater than 1, when a position of the virtual sound source is 90 degrees with respect to a front direction of the listener; and set R to 1, when the position of the virtual sound source deviates more from 90 degrees with respect to the front direction of the listener, and in the case where TL is a first stereophonic transfer function of sound for generating the left channel signal, TR is a second stereophonic transfer function of sound for generating the right channel signal, LD is a transfer function of sound from the left speaker to the first ear, LC is a transfer function of sound from the left speaker to the second ear, RC is a transfer function of sound from the right speaker to the first ear, and RD is a transfer function of sound from the right speaker to the second ear, TL and TR are calculated from a formula:

$$\begin{pmatrix} TL \\ TR \end{pmatrix} = \begin{pmatrix} LD & RC \\ LC & RD \end{pmatrix}^{-1} \times \begin{pmatrix} LVD \times \alpha \\ LVC \times \beta \end{pmatrix}.$$

* * * * *